US006152623A

United States Patent [19]

Palmer et al.

[11] Patent Number: 6,152,623

[45] Date of Patent: Nov. 28, 2000

[54] TAPE PRINTING APPARATUS AND TAPE HOLDING CASES

[75] Inventors: Mathew Richard Palmer; Sam Cockerill, both of Cambridge; Costa Panayi, Royston; Robert Charles Lewis Day, Cambridge; Charles Robert Sims, Royston; Andrew Buchanan Halket, Cambridge, all of United Kingdom

[73] Assignee: Esselte N.V., Sint-Niklaas, Belgium

[21] Appl. No.: 09/180,502

[22] PCT Filed: Sep. 16, 1997

[86] PCT No.: PCT/EP97/05065

§ 371 Date: Nov. 12, 1998

§ 102(e) Date: Nov. 12, 1998

[87] PCT Pub. No.: WO98/16393

PCT Pub. Date: Apr. 23, 1998

[30] Foreign Application Priority Data

Oct. 14, 1996 [GB] United Kingdom ..... 9621379
Aug. 22, 1997 [GB] United Kingdom ..... 9717933

[51] Int. Cl.[7] ..... B41J 11/58

[52] U.S. Cl. ..... 400/208; 400/613

[58] Field of Search ..... 400/208, 613, 400/603; 101/288

[56] References Cited

U.S. PATENT DOCUMENTS

| | | | |
|---|---|---|---|
| 3,823,808 | 7/1974 | Murata et al. | 400/613 |
| 3,924,727 | 12/1975 | Morelli | 400/208.1 |
| 4,983,056 | 1/1991 | Falconieri et al. | 400/208 |
| 5,088,845 | 2/1992 | Kurachi | 400/208 |
| 5,193,919 | 3/1993 | Godo et al. | 400/120 |
| 5,358,351 | 10/1994 | Murata et al. | 400/605 |
| 5,615,960 | 4/1997 | Mori et al. | 400/613 |
| 5,620,268 | 4/1997 | Yamaguchi et al. | 400/603 |
| 5,857,788 | 1/1999 | Gutsell et al. | 400/613 |

FOREIGN PATENT DOCUMENTS

| | | |
|---|---|---|
| 203 664 | 12/1986 | European Pat. Off. . |
| 267 890 | 11/1987 | European Pat. Off. . |
| 315 487 | 5/1989 | European Pat. Off. . |
| 322 919 | 7/1989 | European Pat. Off. . |
| 487 313 | 11/1991 | European Pat. Off. . |
| 607 025 | 7/1994 | European Pat. Off. . |
| 661 163 | 7/1995 | European Pat. Off. . |
| 752 321 | 5/1996 | European Pat. Off. . |
| 0 625 427 A2 | 11/1994 | Japan . |
| 2 161 754 | 7/1984 | United Kingdom . |
| 2 294 907 | 5/1996 | United Kingdom . |

*Primary Examiner*—Stephen R. Funk
*Attorney, Agent, or Firm*—Pennie & Edmonds LLP

[57] ABSTRACT

The invention refers to a tape printing apparatus (2) used with tape cassettes (20, 220, 243, 260, 443). In order to make insertion and removal easier, the tape cassette is provided with a surface controlling the position of a printhead (22, 222, 322, 422) and/or a platen. When the cassette is inserted, printhead and platen are automatically separated such that the tape (24) can be introduced between them, and afterwards moved in the operative position. Further, an over center mechanism is proposed for moving printhead and platen. The tape cassette (443) can provide a 90° bend in the tape (24) upstream the printing position, and the motor (42) can be located besides the zone for accommodating the image receiving tape (24). The cassette can be made attachable to other cassettes, and the means for attaching can guide and hold the cassette in the tape printer.

32 Claims, 13 Drawing Sheets

TAPE PRINTING APPARATUS AND TAPE HOLDING CASES

TECHNICAL FIELD

The present invention relates to tape printing apparatus and also to tape holding cases for tape printing apparatus.

BACKGROUND ART

Known tape printing apparatus of the type with which the present invention is generally concerned are disclosed in EP-A-322918 and EP-A-322919 (Brother Kogyo Kabushiki Kaisha) and EP-A-267890 (Varitronics). These tape printing apparatus each include a cassette receiving bay for receiving a cassette or tape holding case. In EP-A-267890, the tape holding case houses an ink ribbon and a substrate tape, the latter comprising an upper image receiving layer secured to a backing layer by an adhesive. In EP-A-322918 and EP-A-322919, the tape holding case houses an ink ribbon, a transparent image receiving tape and a double-sided adhesive tape which is secured at one of its adhesive coated sides to the image receiving tape after printing and which has a backing layer peelable from its other adhesive coated side. With both these apparatus, the image transfer medium (ink ribbon) and the image receiving tape (substrate) are in the same cassette.

The present applicants have developed a different type of tape printing apparatus which is described for example in EP-A-578372, the contents of which are herein incorporated by reference. In this printing apparatus, the substrate tape is similar to that described in EP-A-267890 but is housed in its own tape holding case while the ink ribbon is similarly housed in its own tape holding case.

The known tape printing apparatus have input means, for example a keyboard, to allow the user to input an image to be printed. A display is generally also provided to display the input image or messages to the user. A cutting arrangement is provided to separate the image receiving tape on which an image has been printed from the supply of image receiving tape to thereby define a label.

In these known tape printing apparatus, the image receiving tape passes in overlap with the ink ribbon through a print zone consisting of a fixed print head and a platen against which the print head can be pressed to cause an image to transfer from the ink ribbon to the image receiving tape. This is usually done by thermal printing where the print head is heated and the heat causes ink from the ink ribbon to be transferred to the image receiving tape. This type of printing is known as thermal transfer printing. Alternatively, the print head may be in direct contact with a thermally sensitive image receiving tape whereby when the print head is heated, an image is printed directly on the image receiving tape. This type of printing is known as direct thermal printing.

In order to allow the one or more cassettes to be inserted, the print head is generally arranged to move between a first non-printing position and a second printing position. When the print head is in the printing position, the image receiving tape and the ink ribbon, if present, are arranged between the print head and a platen with which the print head cooperates. In one known tape printing apparatus, the print head is arranged to be in the first position when a lid of a bay for receiving the cassette or cassettes is open and to be in the second position when the lid of the bay for receiving the cassette or cassettes is closed. (See for example EP-A-487313 in the name of present applicants).

It is has been proposed in EP-A-470648 to provide a lever which moves the print head between the first and second positions. In the tape printer disclosed there, the tape driving mechanism comprises a roller fixed to the frame of the machine, and the cassette is provided with a second roller. The tape is driven between these rollers. The printhead is interacting with a platen, both of which being fixed to the frame of the machine.

In EP-A-327076 (Kroy) a cartridge is provided with a platen. The cartridge is placed in a tray and when a lid of the cartridge receiving bay is closed, the cartridge is moved into a position in which respective elements of the cartridge engage the print head. The print head in this arrangement is stationary.

SUMMARY OF THE INVENTION

U.S. Pat. No. 5,111,216 (Kroy) discloses a tape printer with a detachable cassette, which is releasably fixed on the outside of the housing of the tape printer. The cassette is provided with a planar platen interacting with a print head in the housing of the printer. In this embodiment, there is no driven platen since the tape is manually torn by the user out of the tool, while printing is performed. A roller is provided for sensing the movement of the tape in order to control the print head.

In U.S. Pat. No. 5,435,657 (Smith Corona), a tape printer is used in combination with a slot-in type cassette. The printhead is pivotally fixed to the housing of the tool and interacts with a platen provided in the cassette. Since the printhead is spring biased towards the platen, it is capable of urging the cassette out of the printer, when the latches holding the cassette are released.

U.S. Pat. No. 3,823,808 (Canon Kabushiki Kaisha) describes another tape cassette, which is used in combination with a pocket calculator, which prints inputted and calculated data onto a tape in order to dispense with a display. A tape cassette is provided with a planar platen interacting with a printhead fixed to the housing of the printer. Further, a feed roller is provided on the cassette, interacting with a roller of the machine in order to drive the tape out of the cassette. In order to make the printed data more easily visible to the user, the tape in the cassette is bend for about 45° before printing.

U.S. Pat. No. 5,358,351 (Casio Computer Co., Ltd.) discloses a printing apparatus in which a sheet-like printing medium or a tpa-like tape cartridge can be mounted. The printhead of the apparatus can print on both media. The tape cassette is formed such that a bend of 90° is performed downstream the printhead, such that the tape emerges in vertical direction from the cassette.

All of the above-described solutions are relatively complex and hence costly, since they require a complex printhead moving mechanism, or a platen in the cassette, which makes the cassette, which usually is a one way product and thrown away when the tape is used up, much more expensive. Some prior art embodiments are user unfriendly, since they require additional actions from the user in order to bring the printhead into the operative position, additional to closing a lid of a cassette bay. It is therefore desirable to simplify the mechanism for moving the print head between the printing and non-printing positions to thereby reduce the manufacturing costs of the tape printing apparatus and the cassette.

According to one aspect of the present invention there is provided a tape holding case for use with a tape printing apparatus having a print head for printing an image on an image receiving tape, and a surface, said print head and said surface having a first printing position in which said print head acts against said surface and a second non-printing position in which said print head and said surface are spaced apart, said tape holding case housing a supply of image receiving tape and having an interaction portion for separating the print head and the surface so that the print head and the surface are in the second position during insertion of the tape holding case in the tape printing apparatus, said interaction portion being arranged so that the print head and said surface are in the first position when the tape holding case is received in said tape printing apparatus.

By using the tape holding case to separate the print head and the surface, the tape printing apparatus can be simplified in that no mechanism is required to cause the print head to adopt the printing and non-printing positions. The cost of the tape printing apparatus can thereby be reduced.

It should be appreciated that in embodiments of the present invention, the surface against which the print head acts may be stationary at all times whilst the print head moves to cause the first and second positions to be adopted. Alternatively, the print head may be stationary whilst the surface moves to cause the first and second positions to be adopted. It is also possible that both print head and the surface be movably mounted. In the preferred embodiment of the present invention, the surface is substantially stationary whilst the print head is arranged to move.

Preferably, the print head and the surface are normally in the first position and the interaction portion is arranged during insertion to cause the print head and the surface to adopt the second position, said print head and surface being in the first position when the tape holding case is received in said tape printing apparatus. For example, the print head may be biased to the first position so that the interaction portion of the tape holding case acts against the biasing force to move the print head to the second position.

Preferably said interaction portion comprises a nose portion or control surface extending generally in the direction of insertion. Thus as the tape holding case is inserted, the interaction portion can cause the print head and the surface to adopt the second position.

Preferably said nose portion or control surface has a first surface shaped to gradually move the print head and/or the surface to cause the print head and surface to adopt the second position as the tape holding case is inserted and a second surface shaped to gradually move back the print head and/or the surface to cause the print head and surface to adopt the first position so that when the tape holding case is fully inserted in said tape printing apparatus, said print head and the surface are in the first position. The gradual movement of the print head and/or the surface reduces the possibility of any damage occurring to the print head.

Preferably, said first and second surfaces are angled in opposite directions. This permits the print head and/or surface to be eased from the first position to the second position and back to the first position.

Preferably a window is provided in said tape holding case adjacent said interaction portion, said image receiving tape being arranged to extend across said window, whereby when the tape holding case is received in said tape printing apparatus, the print head and the surface are in the first position with the print head on one side of the window and the surface against which the print head acts on the other side of the window.

Preferably, said print head is mounted on a support member and said interacting portion is arranged to contact said support member during insertion of said tape holding case. By contacting the support member rather than the print head itself, the possibility of damage occurring to the print head can be reduced.

Preferably, said interacting portion is arranged to contact said print head support member above and/or below the print head.

In one preferred embodiment of the invention, the interaction portion has guide means for guiding said image receiving tape. By using the interaction portion also to provide guide means for the image receiving tape, the risk of tape jamming can be reduced. Tape jamming may occur in conventional tape printing apparatus if the tape gets caught on for example the print head or the platen so that it can not be driven through the tape printing apparatus. This is a problem which may arise during insertion of the cassette in the cassette receiving bay.

In one preferred embodiment of the present invention, the guide means is provided by the nose portion. Thus, a single part of the tape holding case provides not only a means by which the print head and the associated surface can be separated but also guide means for the image receiving tape.

In some embodiments of the present invention, the tape holding case is provided with reinforcing means for reinforcing the interaction portion. In those embodiments where the interaction portion extends from the main body of the tape holding case, the interaction portion may be relatively weak and susceptible to damage. The reinforcing means reduces the likelihood of damage occurring to the interaction portion. These reinforcing means together with the interaction portion on the main body of the tape holding case may define a recess in which the print head or surface of the tape printing apparatus is receivable.

Preferably the tape holding case can be used in combination with a tape printing device.

According to a second aspect of the present invention, there is provided a tape printing apparatus for printing an image on an image receiving tape and a tape holding case as described above, the tape printing apparatus comprising:

receiving means for receiving the tape holding case;

a print head for printing an image on said image receiving tape; and a surface against which said print head acts during printing, said print head and said surface having a first printing position in which the print head acts against the surface, wherein when said tape holding case is inserted in said receiving means, said print head and/or said surface are moved by said interaction portion of the tape holding case so that the print head and surface have a second non-printing position in which said surface and said print head are spaced apart and when said tape holding case is received in said receiving means the print head and said surface are in said first position.

According to a third aspect of the present invention, there is provided a tape printing apparatus for printing an image on image receiving tape, comprising:

means for receiving a supply of image receiving tape;

a print head for printing an image on said image receiving tape, said print head having a first position in which the print head acts against a surface to print an image on the image receiving tape, a second non-printing position and a third position intermediate said first and second positions; and moving means arranged automatically to move said print head from said third position to said first position when said print head is at the third position.

By arranging the moving means automatically to move the print head from the third position to the first position when the print head is at the third position, the need to apply a large external force to cause the print head to adopt the required position is removed.

Preferably the moving means comprises biasing means. The biasing means may take the form of a spring. In a preferred embodiment of the present invention, the spring comprises a tension spring which is in a minimum state of tension when in the first and second positions but is in a greater state of tension when in the third position. The increased state of tension of the spring, when in the third position, causes the print head to be moved to the first position.

The print head may be mounted on a member, the member having a first portion which co-operates with a supply of image receiving tape as the supply of image receiving tape is inserted in the receiving means, whereby insertion of the supply of image receiving tape causes the print head to move from the second position to the third position. Thus, the insertion of the supply of image receiving tape will cause the print head to be moved from the second to the third position and the moving means will then cause the print head to be moved from the third position to the first position. Thus, embodiments of the invention may permit the displacement which the supply of image receiving tape needs to push the member through to be reduced as compared to other possible arrangements.

One advantage of embodiments of the present invention is that the final print head position (i.e. printing position or first position) is unrelated to the final position of the supply of image receiving tape. The final position of the print head should be accurately controlled and generally the number of components which affect it should be minimized.

The member may have a second portion arranged below the receiving means, the first portion being supported by said second portion and being in said receiving means.

The member may be substantially L-shaped with said print head being mounted on one arm of said L-shape, the first portion of said member being mounted on the other arm of the L-shape and said moving means being coupled to the member.

The first portion may have a sloping surface arranged to contact said supply of image receiving tape as it is inserted into the receiving means. Preferably, as the supply of image receiving tape is inserted, the supply of image receiving tape will contact the sloping surface which will gradually move as the supply of image receiving tape is inserted further into the cassette receiving bay. As the first portion moves, so does the part of the member on which the print head is mounted. The first portion may be arranged to push the supply of image receiving tape out of the receiving means as the print head is moved from the first position to the second position. Thus, the supply of image receiving tape may be easily removed from the receiving means, when required.

The print head preferably has a fourth position intermediate said first and second positions and the moving means is arranged automatically to move the print head from the fourth position to the second position, when said print head is at said fourth position. The fourth position may be intermediate the third and second positions.

Preferably, the moving means comprises an over centre mechanism.

According to a fourth aspect of the invention there is provided a tape printing apparatus for printing on image receiving tape comprising:

means for receiving a supply of image receiving tape;

a print head for printing an image on said image receiving tape;

a surface against which said print head co-operates to print an image on said image receiving tape, said surface having a first position in which said surface acts against the print head and a second position in which the said surface is spaced apart from said print head, said surface further having a third position intermediate said first and second positions; and moving means arranged automatically move said surface from said third to said first position when said surface is at the third position.

According to a fifth aspect of the invention, there is provided a tape holding case housing a supply of image receiving tape, wherein a bend of approximately 90° is provided in the tape upstream the printing position of said tape.

The tape holding case according to this aspect offers several advantages. First of all, the printed image receiving tape emerges from the case in plane in which the printed image can be easily seen by the user, since this plane extends (due to the 90° bend) parallel to the plane defined by the case and the supply of image receiving tape within the case. Since the latter is generally located parallel to the keyboard and the display of the tape printer, the emerging printed tape can be easily seen and checked by the user regarding typing errors. The second advantage is associated with the sixth aspect of the present invention:

Acccording to a sixth aspect of the present invention, there is provided a tape printing apparatus having a platen for driving an image receiving tape through a printing zone, and a motor operatively connected to said platen by means of a gear train, wherein said motor and said gear train are approximately located within a plane in which a supply of said image receiving tape accomodated in said tape printing apparatus is arranged.

It is thus proposed to position the motor and the gear train for driving the platen besides the location in which the tape cassette housing the image receiving tape is accomodated, instead of below the cassette location, as known from the prior art. Thus, a thinner machine can be built.

It is proposed that the rotational axis of said platen extends parallel to the plane in which the supply of said image receiving tape accomodated in said tape printing apparatus is arranged. Thus, the case according to the fifth aspect of the present invention is used in combination with the tape printer according to the sixth aspect of the invention, which tape holding case allows due to the 90° bend to have a platen arranged orthogonal with respect to the supply of image receiving tape. This reduces the height required for the driving mechanism of the tape, and a thin tape printer is the advantageous result.

According to a seventh aspect of the invention, there is provided a tape holding case housing a supply of image receiving tape, the tape holding case comprising a casing having means thereon for attaching the tape holding case to a second tape holding case. The proposed tape holding case is thus easily stackable.

There is further, according to an eigth aspect of the invention, provided a tape printer in combination with a tape holding case with means for attaching it to a second tape holding case, wherein the tape printer has a zone for receiving the tape holding case, wherein the zone comprises elements interacting with the means of the tape holding case for attaching it to a second tape holding case.

Thus, the means for attaching the tape holding case to a second one can further serve to guide and hold the tape holding case in the respective tape printer.

For a better understanding of the present invention and as to how the same may be carried into effect, reference will now be made by way of example to the accompanying drawings in which:

FIG. 1 shows a plan view showing the front of a tape printing apparatus;

FIGS. 2*a* to *c* show a schematic plan view of a first cassette receiving bay with a first cassette, FIGS. 2*a* to 2*c* showing the three stages during the insertion of the cassette in the cassette receiving bay;

Figure 10:
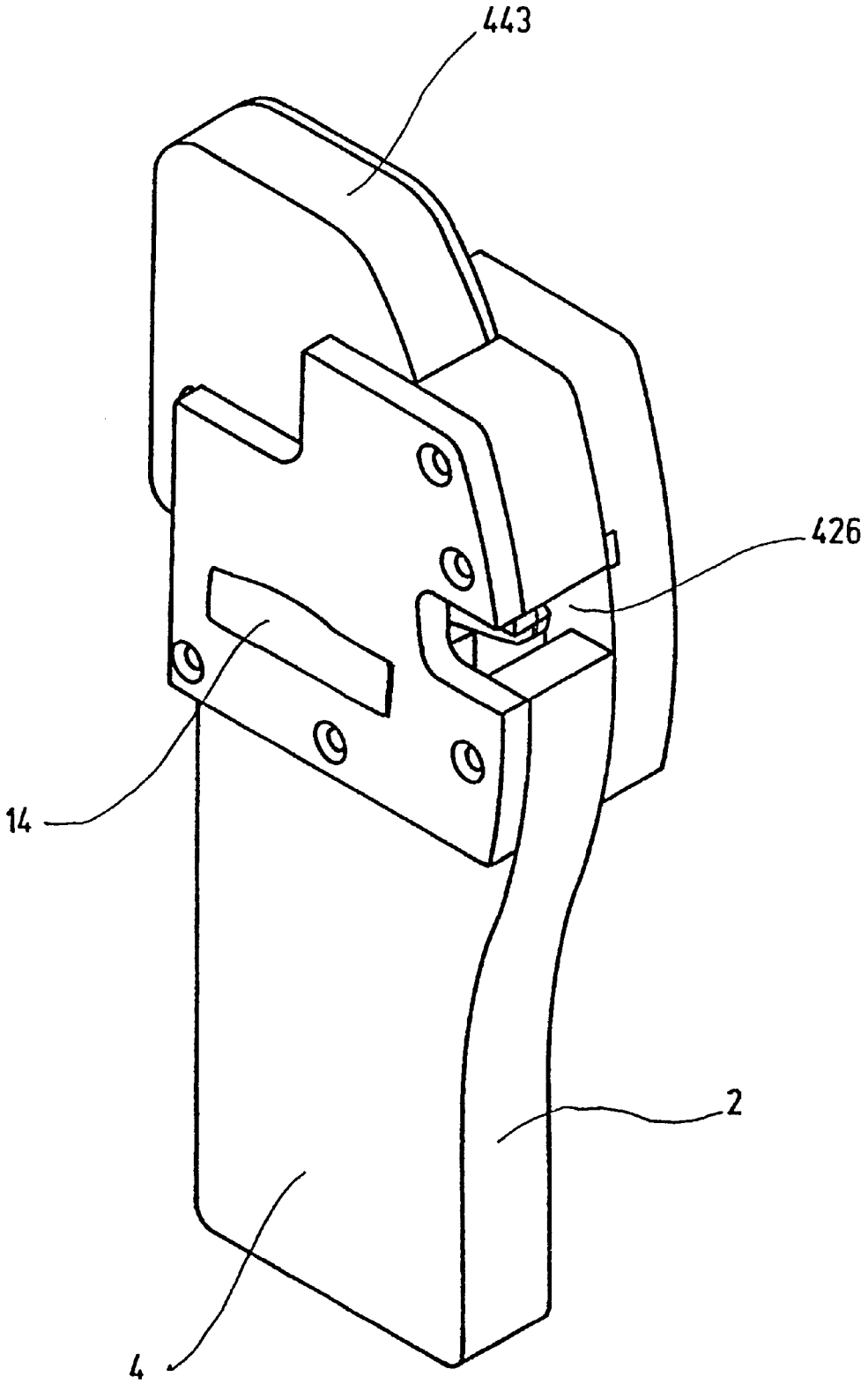
FIG. 10 is a view showing a second tape printing apparatus.
Figure 15:
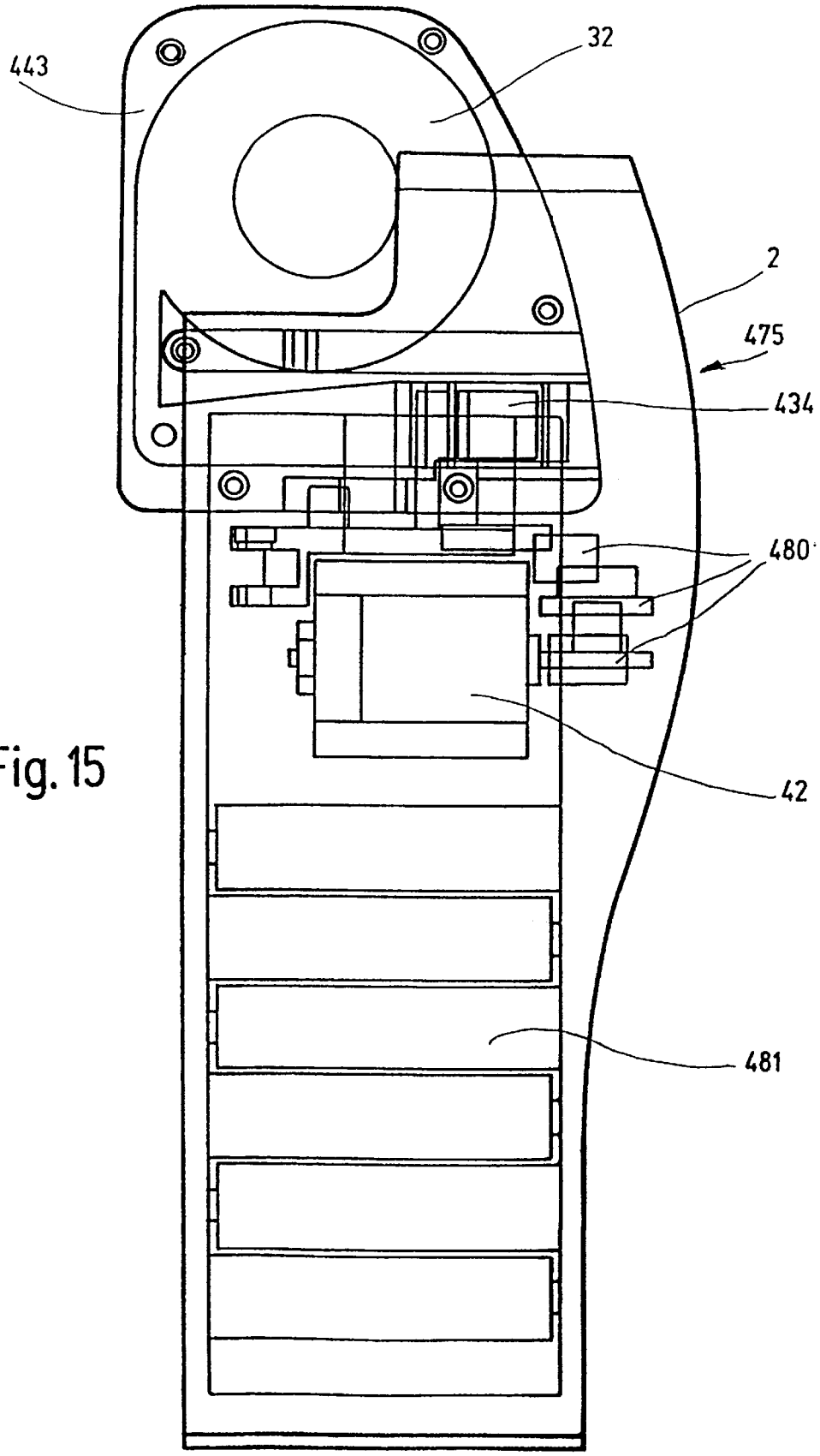
Figure 16:
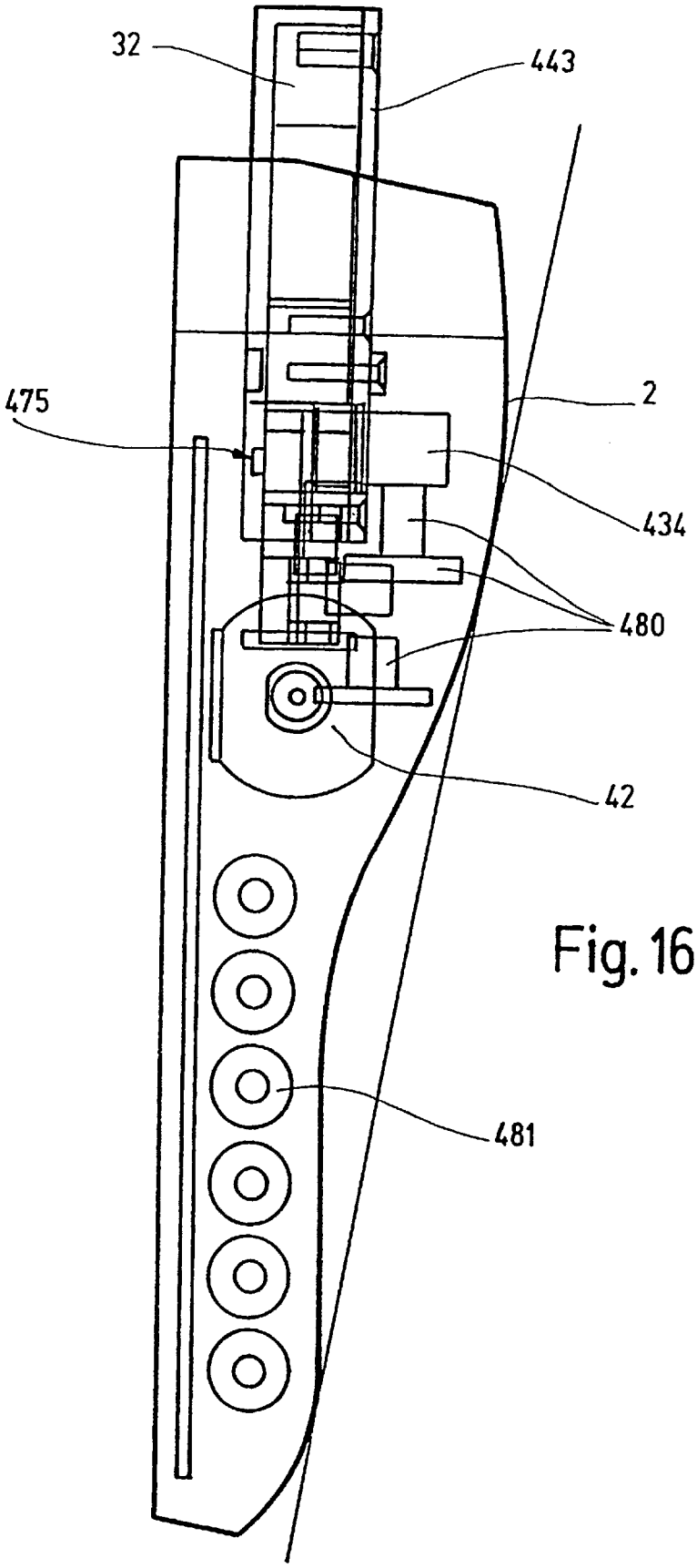
Figure 17:
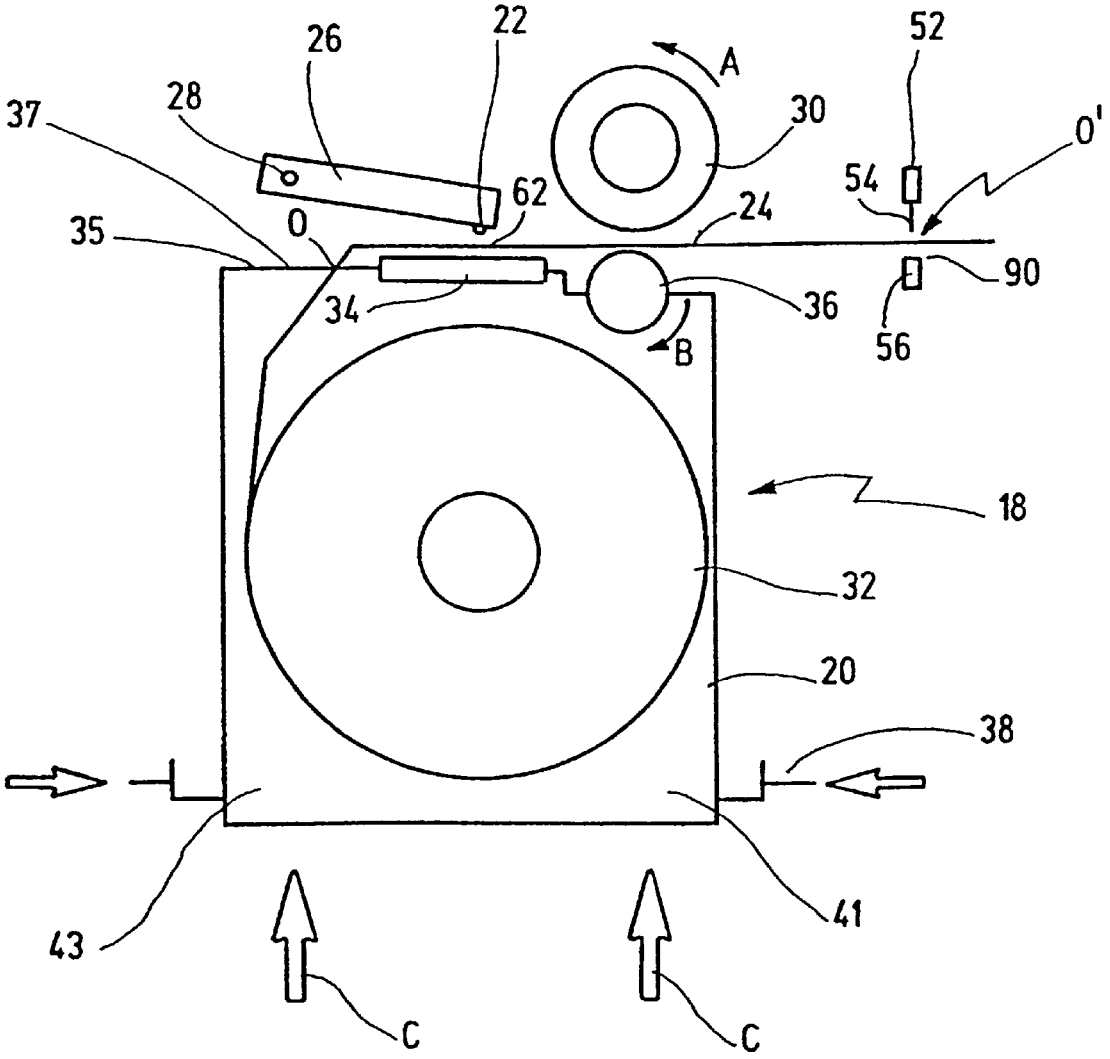
Figure 18:
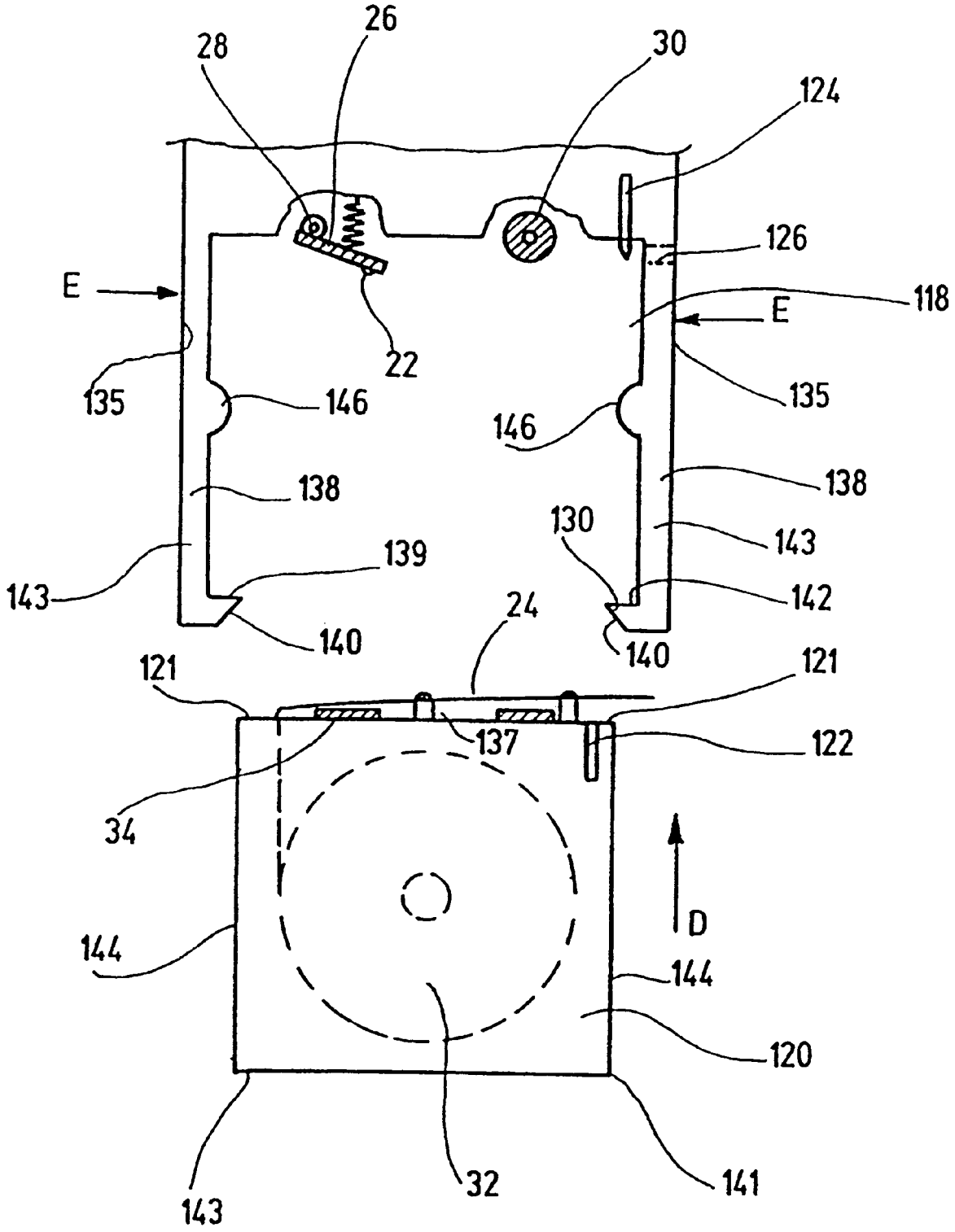

FIGS. 14*a* to *e* show a schematic plan view of the cassette receiving slot of the apparatus of FIG. 10 with the cassette of FIG. 11, FIGS. 14*a* to 14*e* showing five stages during the insertion of the cassette in the cassette receiving slot;

FIG. 15 is a view showing the interior of the apparatus of FIG. 10;

FIG. 16 is a side view on the apparatus of FIG. 15;

FIG. 17 is a schematic plan view of a fifth cassette receiving bay in which a fifth cassette is inserted; and FIG. 18 is a schematic plan view of a sixth cassette receiving bay with a sixth cassette inserted therein.

DETAILED DESCRIPTION OF THE PREFERRED EMBODIMENTS

Figure 1:
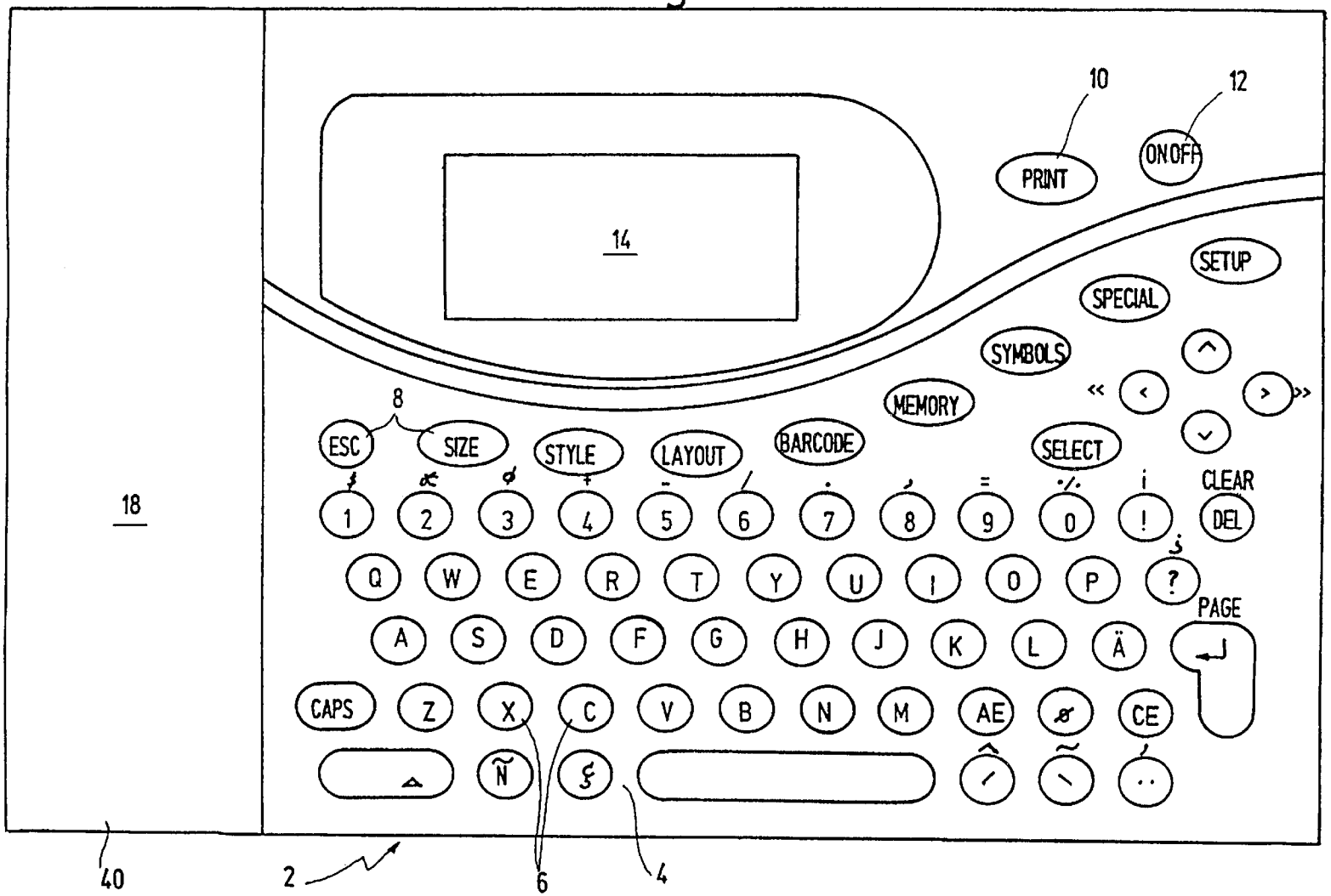

FIG. 1 shows a plan view of a tape printing apparatus 2. The tape printing apparatus 2 comprises a keyboard 4. The keyboard 4 has a plurality of data entry keys such as numbered, lettered and punctuation keys 6 for inputting data to be printed as a label and function keys 8 for editing the input data. The keyboard 4 may also have a print key 10 which is operated when it is desired that a label be printed. Additionally, an on/off key 12 is also provided for switching the tape printing apparatus on and off.

The tape printing apparatus 2 has a liquid crystal display (LCD) 14 which displays the data as it is entered. The display 14 allows the user to view all or part of the label to be printed which facilitates the editing of the label prior to its printing. Additionally, the display 14 is driven by a display driver 16 which can be seen in FIG. 9.

Next to the keyboard 4 of the tape printing apparatus 2, there is a cassette receiving bay 18 which is arranged to receive a cassette 20 housing a supply of image receiving tape 24. The cassette receiving bay 18 is generally covered by a cassette bay lid 40. Various embodiments of the cassette receiving bay 18 and the cassettes to be received therein will now be described in relation to FIGS. 2 to 16.

A first embodiment of the present invention will now be described with reference to FIGS. 2*a* to *c*, 3 and 4. These Figures show the key elements present in the cassette receiving bay 218. In this embodiment, a print head 222 is mounted on a print head arm 226 which is pivotable about pivot point 228. The pivot point 228 is arranged at one end of the print head arm 226 whilst the print head 222 is arranged at the other end thereof. The print head 222 acts against a rotatable platen 234 which is provided in the tape printing apparatus 2. The print head 222 is biased in a direction towards the platen 234. The platen 234 rotates in the direction of arrow F to drive the image receiving tape 24 through the tape printing apparatus 202 as an image is printed thereon.

In addition to a supply spool 232 of image receiving tape 24, the cassette 220 includes a nose portion 240 which extends outwardly from the main body 243 of the cassette 220. The cassette 220 is inserted into the cassette receiving bay 218 in the direction of arrow G, with the nose portion 240 forwardmost.

Figure 3:
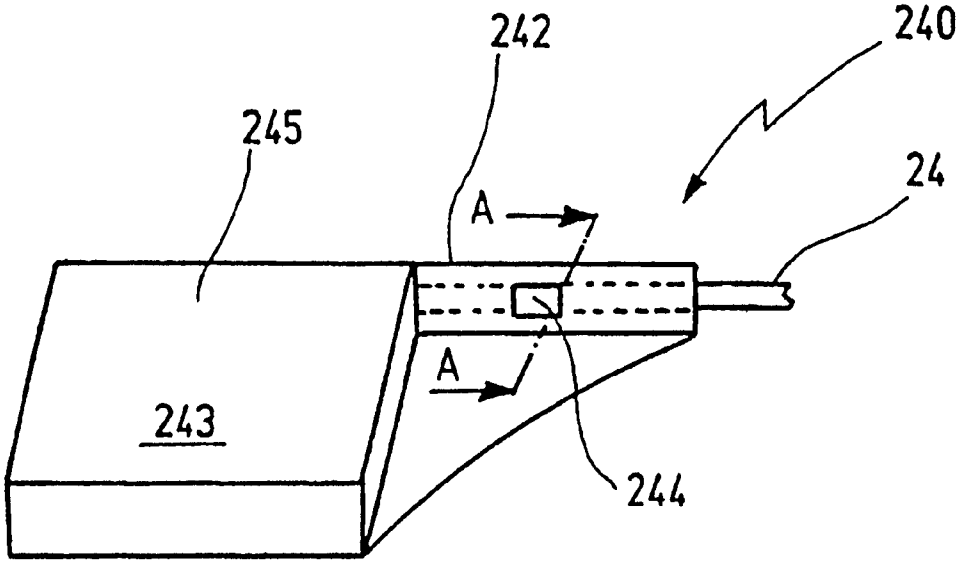
FIG. 3 shows a perspective view of the cassette shown in FIGS. 2*a* to *c*.
Figure 4:
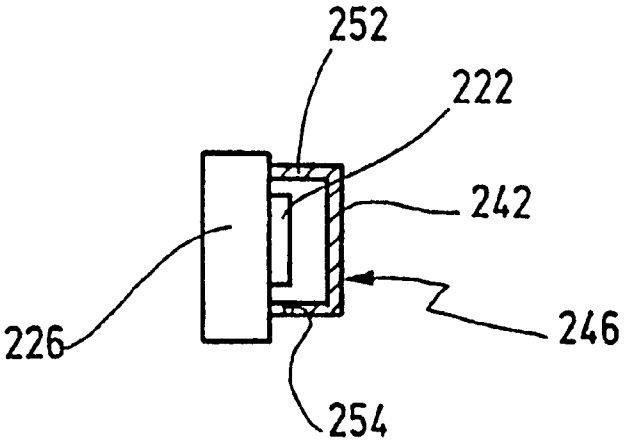
FIG. 4 shows a cross-sectional view of part of the cassette shown in FIG. 3 along line A—A.

The nose portion 240 will now be described with reference to FIGS. 2*a* to *c* as well as FIGS. 3 and 4. The nose portion 240 comprises a wall 242 extending parallel to the plane of the image receiving tape 24. This wall 242 is effectively a continuation of one of the walls 245 of the main body 243 of the cassette 220. A window 244 is defined in this wall 242. The window 244 is positioned such that when the cassette 220 is in the position shown in FIG. 2*c*, that is fully received in the cassette receiving bay 218, the platen 234 is on one side of the window 244 and the print head 222 is on the other side thereof. The window is also sufficiently large so that the print head 222 can be biased against the platen 234 through the window 244 so that an image is printed on the image receiving tape 224 and the image receiving tape 224 is also driven through the tape printing apparatus.

Figures 2A, 2B, 2C:
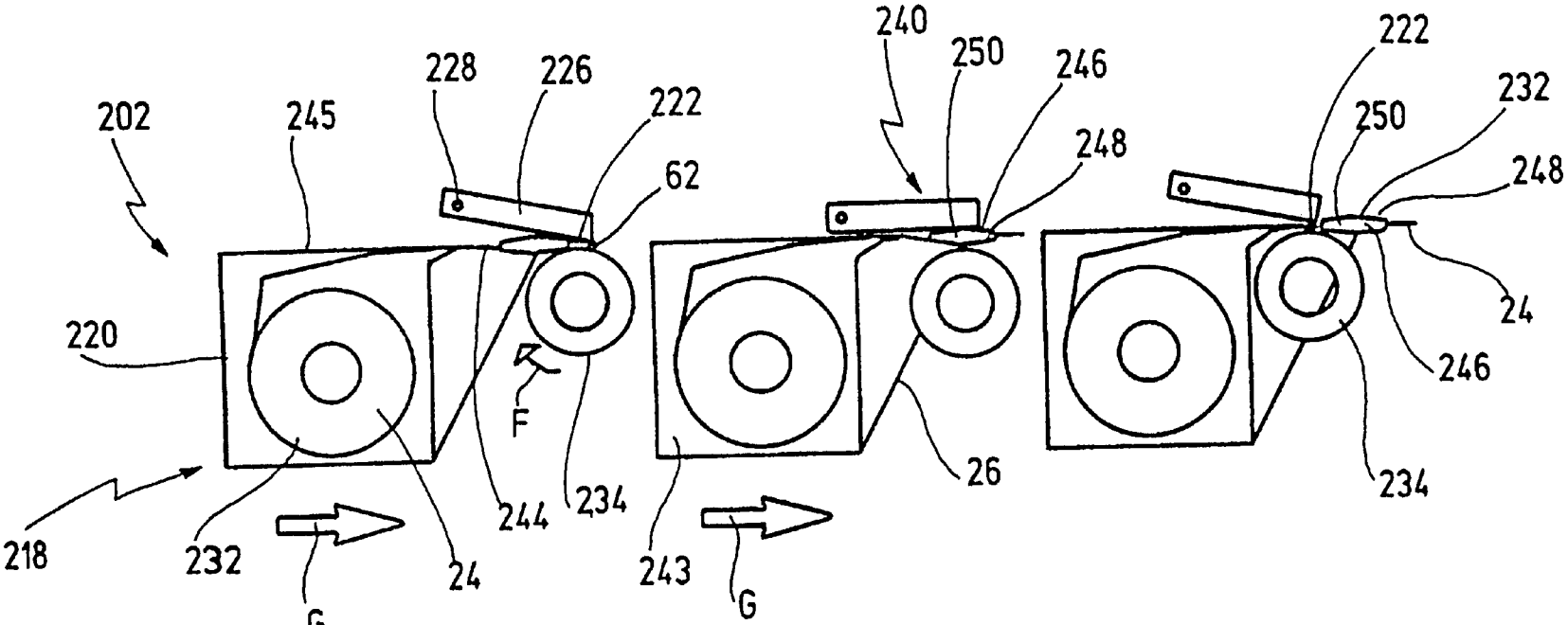

Also provided on the wall 242 of the nose portion 240, which can be seen particularly clearly from FIGS. 2*a* to 2*c* is a bulged portion 246. The bulged portion 246 is provided directly adjacent the window 244 on the side of the window further from the spool 232 of image receiving tape 24. The bulged portion 246 extends outwardly from the plane of the wall 242 both on the side of the wall 242 adjacent the print head 222 and the opposite side of the wall 242. The purpose of this bulged portion 246 is to move the print head 222 away from the platen 234 when the cassette is first inserted (see FIGS. 2*a* and 2*b*) and subsequently to allow the print head 222 to contact platen 234 when the cassette is fully inserted as shown in FIG. 2*c*.

On the side of the bulged portion 246 adjacent the print head 222, two sloping sides 248 and 250 are provided. The two sloping sides 248 and 250 slope outwardly in a direction away from the print head 222 from a common point 232. When the cassette 220 is first inserted in the cassette receiving bay 218 in the direction of arrow G, the print head 222 comes into contact with the first sloped surface 248 which slopes in a direction toward the print head 222 to point 232. As the cassette 220 continues to be pushed into the cassette receiving bay 218, the print head 222 is urged by the sloping surface 248 to pivot in a direction away from the platen 234, about pivot point 228. As the cassette 230 continues to be inserted, the print head 22 moves into contact with sloping surface 250, which slopes from point 232 in a direction towards the platen 234. Finally, when the cassette 220 is fully received in the cassette receiving bay 218 as shown in FIG. 2*c,* the print head 222 is over the window 244 and contacts the image receiving tape 24 which extends there across. The print head 222 then acts against the platen 234 such that an image can be printed on the image receiving tape 24 and the image receiving tape 24 is driven through the tape printing apparatus. The reverse process occurs when the cassette 220 is removed from the cassette receiving bay 218 so that the print head 222 is moved out of contact with the platen 234 whilst the cassette 220 is being removed from the cassette receiving bay.

It should be appreciated that the bulged portion 246 will generally be arranged to contact the print arm 226 on which the print head is supported rather than the print head 222 itself to thereby avoid damaging the print head 222. Thus, the bulged portion 246 contacts the print head arm 226 at a location above and/or below the print head 222. The bulged portion 246 may therefore have a U-shaped cross-section such as shown schematically in FIG. 4. As can be seen in this embodiment, the two arms 252 and 254 of the U-shaped cross-section contact the print head arm 226 above and below the print head 222.

Figure 8:
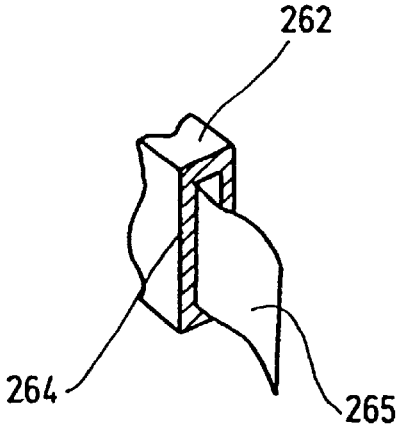
FIG. 8 shows an enlarged view of the nose portion of the cassette of FIG. 7.
Figure 7:
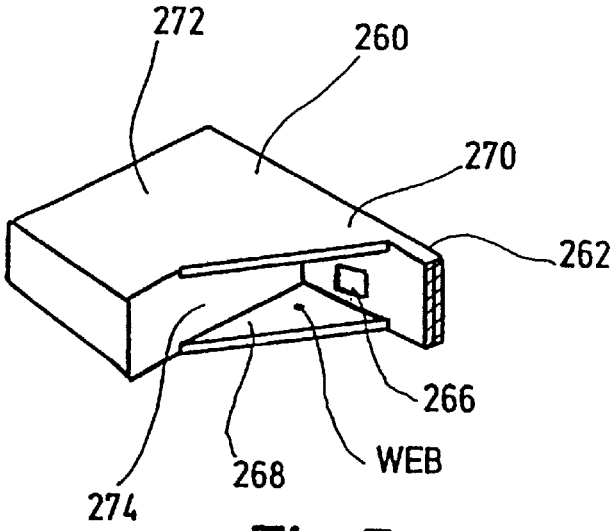
FIG. 7 shows a modified version of the cassette of FIG. 3.

Reference will now be made to FIGS. 7 and 8 which show a second embodiment, which is a modification of the embodiment shown in FIGS. 2*a* to *c,* 3 and 4. In the embodiment shown in FIGS. 7 and 8, the cassette 260 has a nose portion 262. For clarity, the bulged portion has been omitted from the arrangement shown in FIGS. 7 and 8. However, the embodiment shown in FIGS. 7 and 8 would incorporate the bulged portion discussed in relation to the previous embodiment. The nose portion 262 has, as can be clearly seen from FIG. 8, a boxed-shape cross-section 264 which encloses the image receiving tape 265. As with the embodiment shown in FIGS. 2 to 4, the nose 262 is provided with a window 266 which permits the print head to act against the platen whilst an image is being printed on the image receiving tape. The box section 264 has the advantage that the risk of tape jams is considerably reduced.

The cassette 260 shown in FIG. 7 has two triangular portions 268 and 270 extending between the nose portion 262 and the main body 272 of the cassette 260. The triangular regions 268 and 270 are coplanar with the bottom surface of the cassette 260 and the top surface of the cassette 260 respectively. These triangular web portions 268 and 270 reinforce the nose portion to increase the resistance to damage of the nose portion 262. The print head may be received in the enclosed space defined by the two triangular web portions 268 and 270 along with an inner wall portion of the nose portion 262 and the wall 274 of the cassette body 260. Alternatively, the arrangement may be such that a platen could be accommodated in that recess. The web portions 268 and 270 may be of any suitable material such as plastics. The embodiment shown in FIGS. 7 and 8, may be modified so that no bulged portion is provided on the nose portion 262. The nose portion 262 on its own may be sufficient to move apart the print head and the platen against which the print head cooperates. However, it is preferred that the bulged portion be present. This has the advantage that the nose portion does not contact the print head itself avoiding the possibility that the print head might be damaged.

Figure 5:
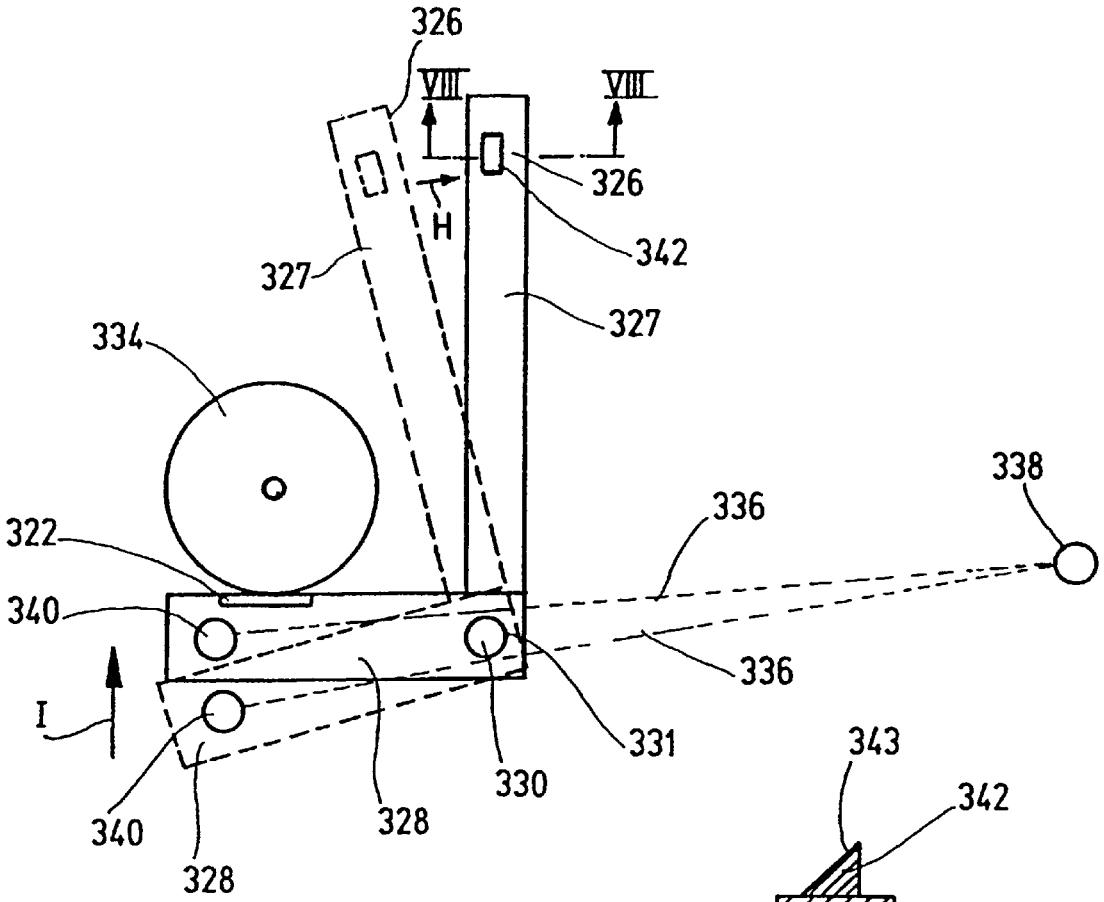
FIG. 5 shows a view from above of a portion of a third cassette receiving bay with no cassette present.

Reference will now be made to FIG. 5 which shows a third embodiment of the present invention. In FIG. 5, the position of the print head arm 326, when closed is shown in solid lines whilst the position of the print head arm 326 when in the open position is shown in dotted lines. The print head arm 326 comprises a first portion 327 and a second portion 328. The print head arm portions 327 and 328 together define an L-shaped print head arm 326. The print head arm 326 is pivotable about pivot point 330 which is arranged at a corner region 331 of the L-shaped print head 326. The second print head arm portion 328 carries the print head 322 itself. The print head 322 is arranged to cooperate with a rotatable platen 334.

A print head spring 336 is attached at one end to a spring anchor point 338 and at the other end to an attachment point 340 on the print head arm 326. The spring 336 is an extension spring which is arranged to be held under tension. It should be appreciated that the first portion 327 of the print head arm 326 will in use be arranged below the floor of the cassette receiving bay. A wedge 342 is arranged on the first portion 327 of the print head arm 326. This wedge 342 is arranged to extend above the floor of the cassette receiving bay and is shown in more detail in FIG. 6.

When the cassette receiving bay is empty, the print head arm 326 is in the position shown in dotted lines in FIG. 5. A cassette is arranged to be inserted into the cassette receiving bay in the downward direction, that is in a direction towards the plane of the page containing FIG. 5. As the cassette is inserted, it engages the wedge, which can be seen in FIG. 6. As the cassette is moved downwardly, the bottom edge of the cassette engages the wedge 342 at location 343 gradually moving the wedge and hence the first portion 327 of the print head arm 326 in the direction of arrow H. As the print head arm 326 is pivotably movable about pivot point 330, the second portion 328 of the print head arm 326 moves in the direction of arrow I towards the rotatable platen 334. As the second part 328 of the print head arm 326 moves towards the rotatable platen 334, the length of the spring 336 extends slightly until it reaches a maximum length when the print head arm 326 is in a position halfway between those two positions illustrated in FIG. 7. Once the print head arm has passed this halfway point, the tension in the spring 336 urges the spring to the position shown in solid lines in FIG. 7 so that the print head 322 is in contact with the rotatable platen 334.

In order to remove the cassette, the user moves the print head arm 326 from the position shown in solid lines in FIG. 7 to the position shown in dotted lines. As the print head arm 326 moves towards the position shown in dotted lines, the wedge portion 324 acts against the cassette to push it up out of the cassette receiving bay. The print head arm 326 may be operated by turning a lever or pressing a button.

Thus, the print head 323 is mounted on a print head arm 326 on which the cassette acts on, via the wedge 342, as the cassette is inserted. The spring 336 is arranged to pull the print head 322 into the printing position in which the print head 322 acts against the platen once cassette insertion has caused the print head to move a relatively short distance from the open position (shown in dotted lines). This has the advantage that the cassette itself does not have to oppose the print head force.

Figure 9:
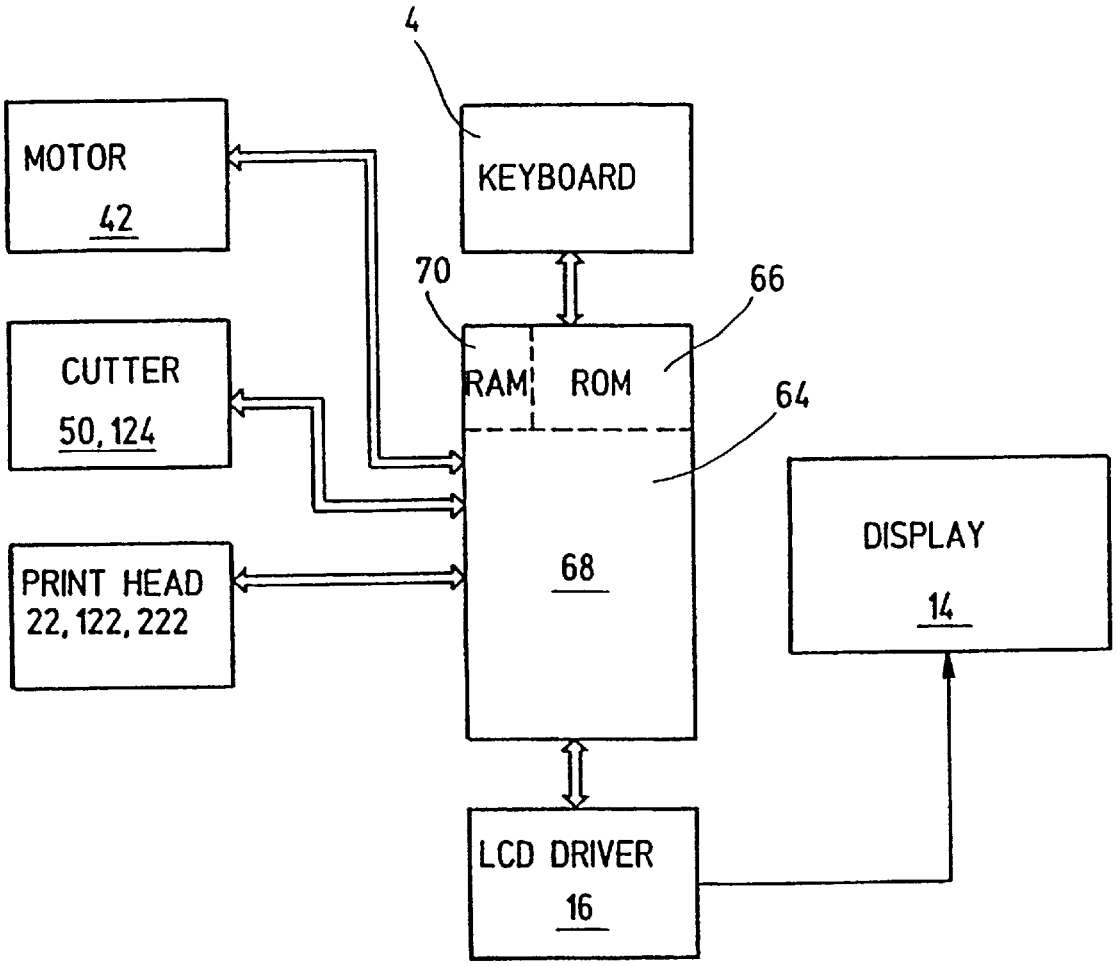
FIG. 9 is a simplified block diagram of control circuitry for controlling the tape printing apparatus.

Reference will now be made to FIG. 9 which generally shows a simplified block diagram of control circuitry which can be used with any of the described embodiments. A drive roller 30 (see FIGS. 15 and 16) and/or the rotatable platen 234 are driven by the motor 42 so that it rotates to drive the image receiving tape 24 in a direction which is parallel to the lengthwise extent of the image receiving tape 24 through a print zone 62 defined between the print head 22, 122 or 222 and the platen 34 or 234 respectively. In this way, an image can be printed on the image receiving tape 24 as it passes through the print zone 62.

The cutting arrangements described in relation to the fifth and sixth embodiments can be incorporated in any of the embodiments described hereinbefore.

The print head 22, 122, 222 is a thermal print head comprising a column of a plurality of printing elements. The print head is preferably only one element wide and the column extends in a direction perpendicular to the lengthwise extent of the image receiving tape 24. The height of the column of printing elements is preferably equal to the width of the image receiving tape to be used with the tape printing apparatus 2. With embodiments of this invention, where more than one width of image receiving tape 24 is used, the print head column will generally have a height suitable for printing on the largest width of tape 24. An image is printed on the image receiving tape 24 column by column by the print head 22, 122, or 222.

The basic control circuitry illustrated in FIG. 9 comprises a microprocessor chip 64. The microprocessor chip 64 has a read only memory (ROM) 66, a microprocessor 68 and random access memory capacity 70 indicated diagrammatically by RAM. The microprocessor 68 is controlled by programming stored in the ROM 66 and when so controlled acts as a controller. The microprocessor chip 64 is connected to receive label data input to and from the keyboard 4. The microprocessor chip output is connected to drive the display 14 via the display driver chip 16 to display a label to be printed (or a part thereof) and/or a message or instructions for the user. It should be appreciated that the display driver 16 may form part of the microprocessor chip 64.

The microprocessor chip 64 also outputs data to drive the print head 22, 122, 222 to print an image on the receiving tape 24 to form the label. The microprocessor chip 64 also controls the motor 42 for driving the image receiving tape 24 through the tape printing apparatus. The motor 42 may be a dc motor which continuously drives the image receiving tape 24 through the print zone 62 during printing. Alternatively, the motor 42 may be a stepper motor. In this situation, the drive roller 30 or platen 234 rotates stepwise to drive the image receiving tape 24 in steps through the print zone 62 during the printing operation.

The microprocessor chip 64 may also control the cutting arrangement 50 or blade 124 to allow lengths of image receiving tape to be cut off after an image has been printed thereon. The cutting arrangement 50 or blade 124 may alternatively be manually operated.

A fourth embodiment of the invention is shown in FIGS. 10 to 16. The tape printer 2 according to this embodiment is generally brick shaped, and has on its upper end a tape cassette 443 inserted into a corresponding slot, the latter being shown more detained in FIGS. 14*a–e*. A keyboard on the front left side of the tape printer 2 is schematically indicated with reference numeral 4, although the keys as such are for reasons of simplification not shown. The printing mechanism is included into the top part of the tape printer, while the batteries providing the necessary electrical energy are situated inside the lower part of the housing covered with the keyboard 4. The printed tape emerges from an outlet 426 out of the housing of the tape printer 2. A display 14 is provided above the keyboard 4, such that a user can easily see and check his or her inputted data. The cassette 443 has an additional feature (which is not provided in the tools according to the remaining embodiments of the present invention); it provides a bend of 90° in the tape before printing. This will be shown more clearly in FIGS. 11–13. Hence the tape 24 emerges in the plane of the display 14 out of the outlet 426 of the tape printer 2, thus making it easier for the user to control the printed image.

Figure 11:
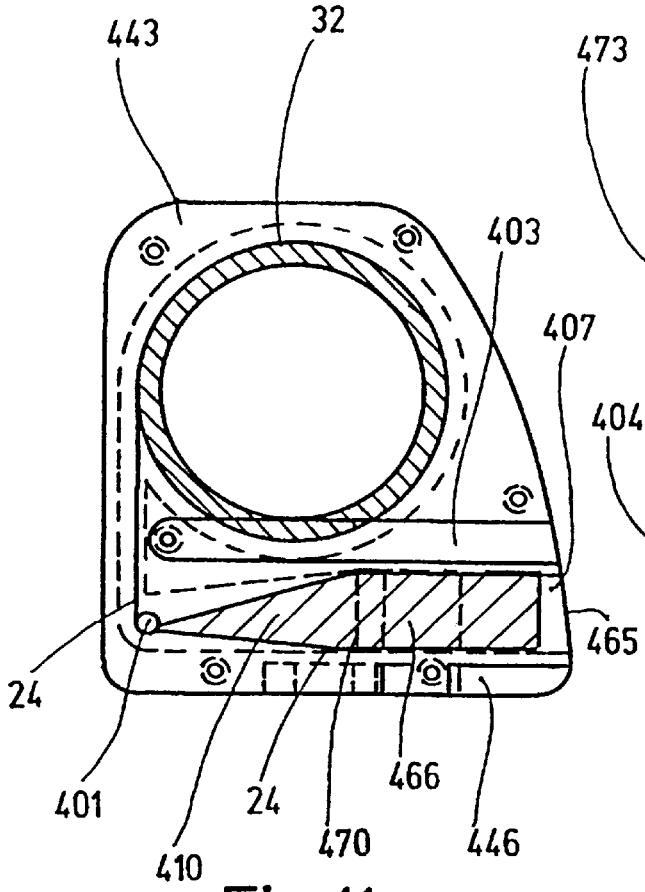
FIG. 11 shows a top view of a cassette for use in the tape printing apparatus of FIG. 10.

FIGS. 11 shows a view onto the cassette 443 of the fourth embodiment. It houses a supply spool 32 of image receiving tape 24. The image receiving tape 24 is guided from the supply spool around a pin 401 extending orthogally to the plane of the side wall of the cassette 443 on which the supply spool 32 lies. The pin 401 is located at the lower left corner of the cassette 443, and deflects the tape for 90°, such that it extends rightwards in FIG. 11, after it has passed the pin 401. Additionally to the deflection performed by pin 401, the tape is downstream the pin 401 lying on a angled, triangular surface 410, which encloses an angle (in this embodiment of 45°) with the length axis of the pin 401. Consequently, the tape 24 is bent by pin 401 and surface 410 such that the image receiving tape 24 extends at the right, downstream end (which is indicated by the dotted line 470) of the angled surface 410 in the plane of the drawing. Thus, the angled surface is designed such that its left end adjacent the pin 401 is extending orthogonally to the plane of FIG. 11, and that its right end 470 extends parallel to the plane of FIG. 11. The right end 470 of surface 410 is located close to the left edge of a window 466 in the housing of the cassette 443. The window 466 is indicated with two parallel dotted lines and is required in order to let a print head 422 and a platen 434 interact in order to print upon the image receiving tape 24. Consequently, the window 466 has the same function as the window 244 in FIG. 3 and window 266 in FIG. 7. At the right end of the cassette 443 an outlet 465 is provided, through which the image receiving tape 24 emerges after it has passed the printing location at window 466. The outlet 465 is shaped similarly to the nose portion 262 shown in FIG. 8. Thus, it has a box-shaped cross section enclosing the image receiving tape 24. This cross section is obtained by a bar 407 extending parallel to the plane of FIG. 11, but having an appropriate distance to the adjacent bottom wall 472 (see FIG. 12) of the cassette 443. A cutting mechanism (not shown) for separating the printed image receiving tape is located downstream the outlet 465.

On the bottom edge (in FIG. 11) of the cassette 443, a surface 446 having a lengthwise extension in the direction in which the cassette 443 is inserted into the tape printer 2 is provided. This surface 446 serves to control the position of the printhead 422 with respect to the platen 434 when the cassette 443 is inserted into the tape printer 2. This will be shown more detained with reference to FIGS. 14*a*–14*e*.

Figure 12:
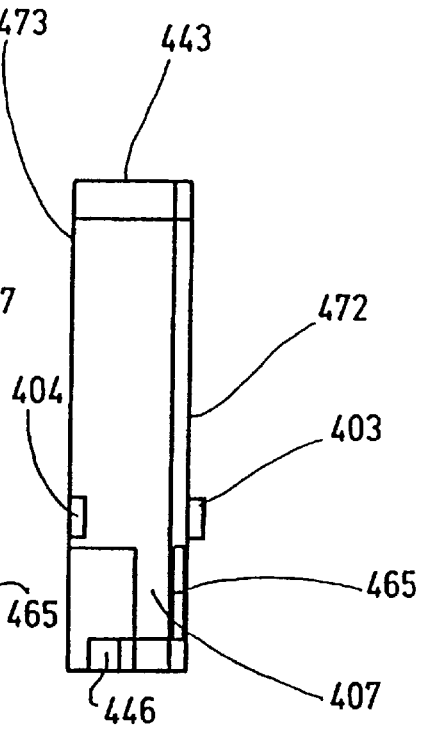
FIG. 12 is a side view of the cassette of FIG. 11.

The housing of the cassette 443 consists essentially of two moulded parts, one of which being a bottom wall 472, and the other one being a cover wall 473, as indicated in FIG. 12. These walls enclose the tape supply spool 32, pin 401, and further parts. FIG. 11 shows a view onto the cover wall 473. It should be noted that the surface 446 can be provided either on the bottom wall 472, or on the cover wall 473, like in the embodiment shown in FIGS. 1–13.

The cassette 443 is provided on its bottom wall 472 with an upstanding projection 403 having a rectangular cross section and extending parallel to the lengthwise direction of the surface 446 for controlling the printhead position. This can best be seen in FIG. 12 showing a side view onto the cassette 443 of FIG. 11. The upstanding projection 403 is located at about ⅓ of the height of the cassette 443. In the cover wall 473 of the housing of the cassette 443, a recess 404 is provided which extends parallel to the upstanding projection 103, and is located at the same height. The cross section of the recess 404 corresponds to the cross section of the upstanding portion 403. The purpose of upstanding projection 103 and recess 104 is twofold: On one hand, they interact with corresponding parts of the cassette receiving slot 475 in order to provide a guidance for the cassette 443 when it is inserted. On the other hand, they allow to stack two or more cassettes 443 together, without any additional elements, thus making storage of cassettes simpler.

Figure 13:
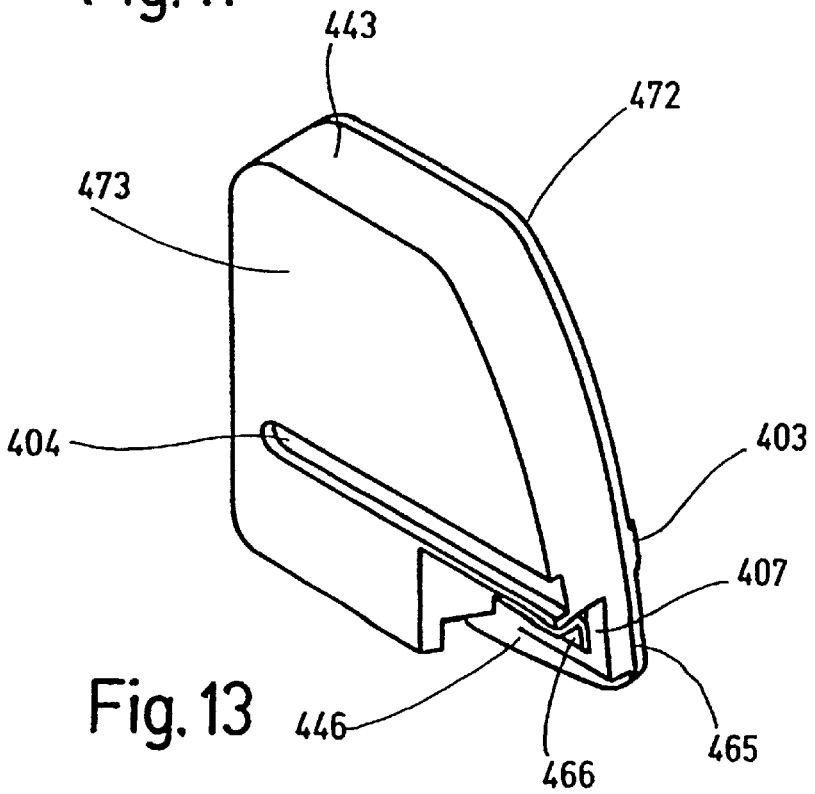
FIG. 13 is a perspective view of the cassette of FIG. 11.

FIG. 13 shows a perspective view of the cassette 443. It is apparent that the distance between surface 446 and the bottom wall 472 varies with increasing distance from the front edge of the cassette 443 which it is inserted in the first place into the tape printer 2. This is necessary in order to control the position of printhead 422 and platen 434 appropriately.

Figure 14A:
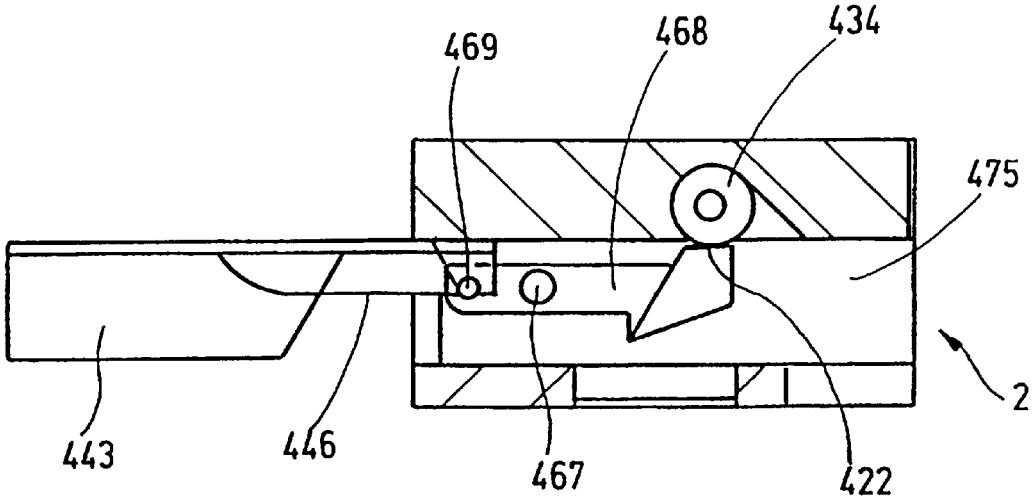

FIGS. 14*a–e* illustrate how cassette 443 and tape printer 2 interact during insertion of the cassette. As shown in FIG. 14*a,* a slot 475 is provided in the tape printer 2 into which the cassette is to be inserted for printing upon the image receiving tape 24. Within the slot 475, a platen 434 and a print head 422 are provided. The platen 434 is driven by a motor (not shown) and located within a recess in a wall of the slot 475. The recess protects the platen 434 against unwanted damages. The printhead 422 is mounted on a printhead holder 468, which is pivotally supported on a pin 469, and spring biased towards the platen 434. When no cassette is inserted, the printhead and the platen are thus in touch with each other. A sensing pin 467 is provided on the printhead holder 468 for interacting with the surface 446 of the cassette 443, and controlling the position of the printhead 422. In the described embodiment, the print head 422 is a thermal print head, but it could be an ink jet printhead, as well. The axis of the printing elements of the printhead 422 extends parallel to the axis of the platen 434, and within the plane of the image receiving tape 24, when it is located at the window 466, thus enclosing an angle of 90° with the center axis of the tape supply spool 32.

In FIG. 14*a,* the cassette 443 has just been inserted into the tape printer 2. Thus, the cassette 443 is only shifted some millimeters into the slot 475, and the sensing pin 467 does not touch the surface 446 of the cassette 443. Consequently, the printhead holder 468 is in its rest position, wherein the printhead 422 is touching the platen 434.

Figure 14B:
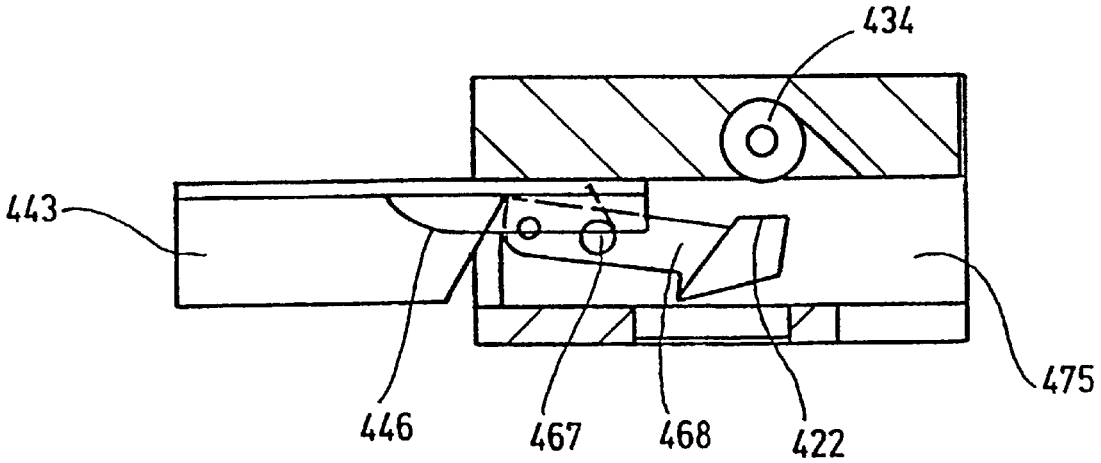

In FIG. 14*b,* the cassette 443 is moved somewhat deeper into the slot 475. The sensing pin 467 is in touch with the surface 446 of the cassette 443. It is apparent that the position of the sensing pin 467 depends on the distance between the point where it touches the surface 446 and the bottom wall 472 of the cassette housing. With other words, the sensing pin 467 scans the shape of the surface 446. Since the surface 446 (its cross section shown in FIGS. 14*a–e*) is approximately sinusoidally curved, the surface 446 has caused the sensing pin 467 to move downward, and thus to rotate the printhead holder 468 clockwise. Consequently, the printhead 422 is separated from the platen 434. This is necessary for introducing the image receiving tape 24 between printhead 422 and platen 434.

Figure 14C:
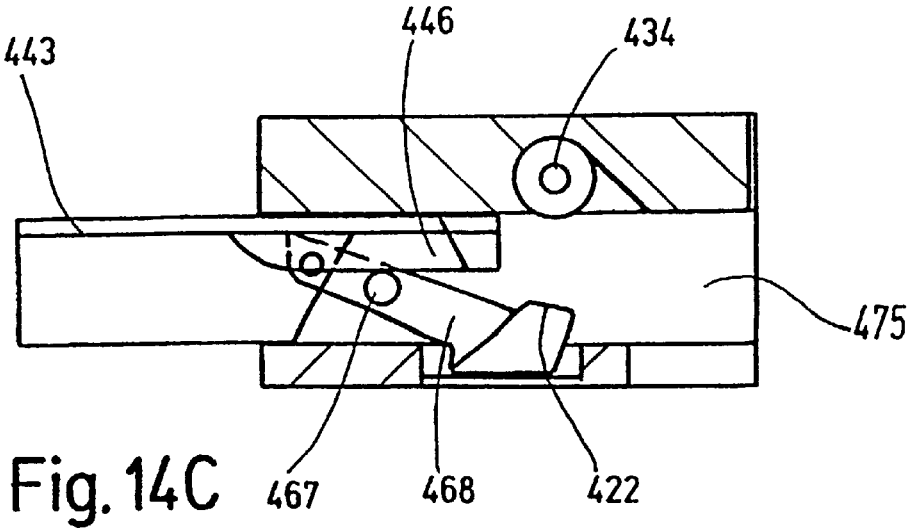

In FIG. 14*c,* the sensing pin 467 is located near the point of the surface 446 having the largest distance between surface 446 and bottom wall 472, ie. the sensing pin is near its peak position. The printhead holder 468 has consequently rotated further such that the printhead 422 is as far as possible away from the platen 434, and nearly touches the wall of the slot 475 opposite to the platen 434. It is thus easily possible to insert the image receiving tape 24 between platen 434 and printhead 422.

Figure 14D:
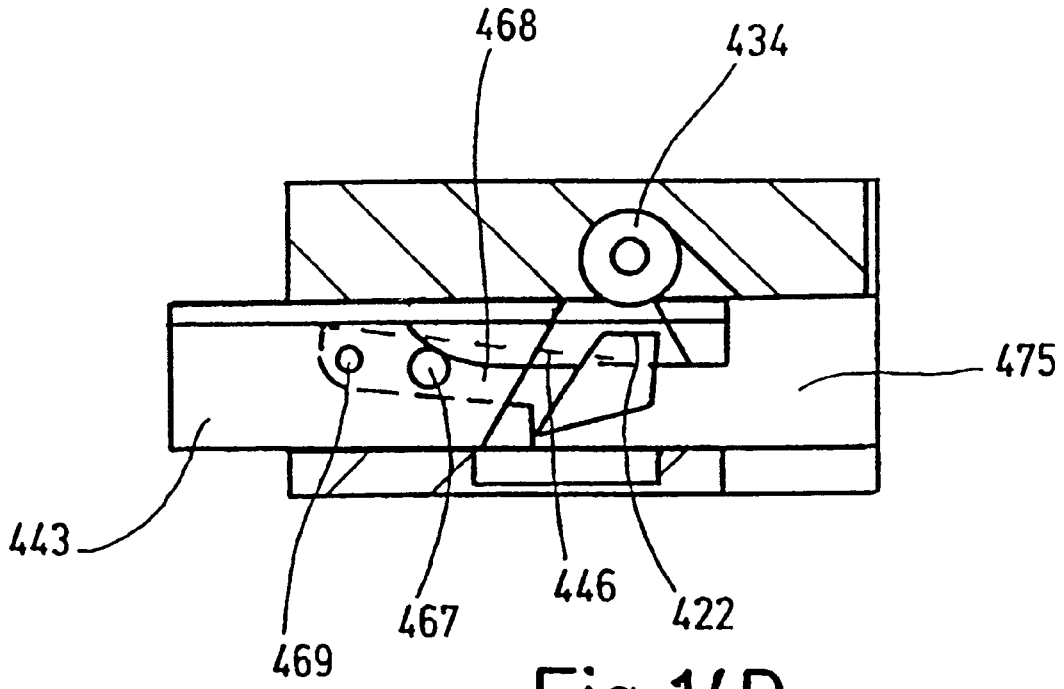

In FIG. 14*d,* the cassette 443 is even further shifted into the slot 475. Since the distance between the surface 446 and the bottom wall 475 is now decreased, the sensing pin 467 has caused the (biased) printhead holder 468 to rotate counter-clockwise such that the printhead 422 has moved towards the platen 434.

Figure 6:
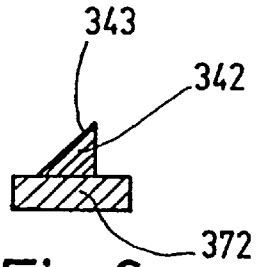
FIG. 6 is a cross-sectional view of part of the print head arm of FIG. 5 along line VIII—VIII.
Figure 14E:
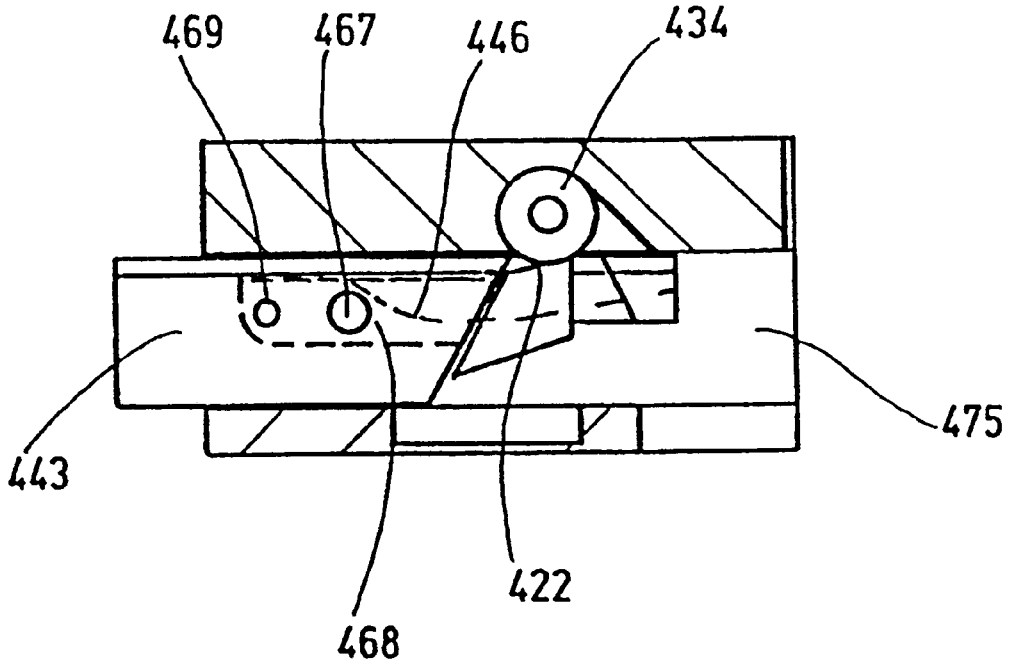

FIG. 14*e* illustrates the final, operative position of the cassette 443. The printhead 422 cooperates with the platen 434 through the window 466 in order to print upon the image receiving tape 24. The printhead holder 468 further arrests the cassette 443 in the operative position since it engages with the window 466. When the cassette 443 is moved out of the slot 475, the printhead holder 468 moves in the reverse direction through the positions indicated in FIGS. 14*a–e*. The cassette 443 thus provides a surface 446 which interacts with the printing mechanism of the tape printer 2 for allowing easy insertion and removal of the cassette. It should be noted that it would be possible to provide a spring for biasing the printhead 422 towards the platen 434 with a sufficient strong force, such that the user only needs to shift the cassette 443 such far that the sensing pin 467 gets into the peak position (FIG. 14*c*), and can then release it, while the spring moves the cassette into the operative position (FIG. 14*e*) or out of the tape printer (FIG. 14*a*). Thus, an over centre mechanism as shown in FIGS. 5 and 6 could be provided in the fourth embodiment of the invention, as well.

FIGS. 15 and 16 illustrate another advantage associated with the 90° bend in the image receiving tape 24 within the cassette 443 before (ie. upstream) the printing position. This 90° bend allows to dispense with a gear train for driving the platen 434 behind the cassette 443. Thus, a thinner tape printer can be achieved. As shown in FIGS. 15 and 16, the motor 42 is located below the cassette slot 475, and within the plane defined by the supply 32 of image receiving tape, and by the cassette 443 housing the supply 32. A gear train 480 is provided for driving the platen 434, wherein the gears are situated below the cassette 443, ie. between motor 42 and platen 434, and approximately lie within the same plane as the motor 42. Since the driving shaft of the motor 42 extends horizontally in FIGS. 15 and 16, and the platen 434 rotates around a vertically extending axis, there is a part of the gear train, ie. a pair of gears, provided which alters the rotation direction for 90°. The driving shaft of the motor 42 and the rotational axis of the platen 434 extend parallel to the plane defined by the supply 32 of image receiving tape, ie. within the plane of FIG. 15. FIGS. 15 and 16 further show the position of batteries 481 in the lower part of the tape printer 2.

Reference will now be made to FIG. 17 which shows a fifth embodiment of a cassette receiving bay 18 with the lid 40 removed. The cassette receiving bay 18 has a thermal print head 22 for printing an image onto a supply of image receiving tape 24. As will be described in more detail hereinafter, the print head 22 is mounted on a print head arm 26 which is pivotable about pivot point 28. A drive roller 30 is driven by a dc motor 42 (see FIG. 9) and rotates in the direction of arrow A in order to drive the image receiving tape 24 through the tape printing apparatus. The cassette 20 housing the supply of image receiving tape 24 is received in the cassette receiving bay 18. The cassette 20 holds a supply spool 32 of image receiving tape 24. The image receiving tape 24 may comprise an upper layer for receiving a printed image on one of its surfaces and its other surface coated with an adhesive layer to which is secured a releasable backing layer. The image receiving tape 24 is guided by a guide mechanism (not shown) through the cassette 20, out of the cassette 20 through an outlet O, past the print head 22 to a cutting location C'. The image receiving tape 24 comprises a thermally sensitive material on which an image is printed when in contact with activated or heated elements of the thermal print head. No ink ribbon is required in order to print an image on the thermally sensitive image receiving tape 24. Some of the embodiments described herein may be modified so that ink ribbon is also provided in the cassette. In these embodiments the image receiving tape may not be thermally sensitive. An image would then be printed on the image receiving tape via the ink ribbon.

A cutting arrangement 50 is provided at the cutting location C'. The cutting arrangement 50 comprises a blade support member 52 which carries a blade 54. The cutting arrangement 50 also comprises an anvil 56 against which the blade 54 acts. In this way, a portion of the image receiving tape 24 on which an image has been printed can be separated from the supply of image receiving tape to thereby define a label.

The cassette 20 has a platen 34 in the form of, for example, a flat substantially planar resilient pad, mounted on the outside of the housing 35 of the cassette 20. In particular, the housing 35 of the cassette 20 has a side wall 37, parallel to the axis of rotation of the supply spool 32, which confronts the print head 22. The platen 34 is provided on the surface of this wall 37. This platen 34 may be of any suitable material such as rubber or the like. The platen 34 is arranged so that in use the platen 34 comes into contact with the print head 22 with the image receiving tape 24 therebetween. The print head 22 can then act against the platen 34 during printing to provide a good quality image.

An idler roller 36 is also provided in the cassette 20 which cooperates with the drive roller 30 in the tape printing apparatus to drive the image receiving tape 24 through the tape printing apparatus 2. The idler roller 36 is partially housed in the cassette 20 and partially extends outwardly of the side wall 37 on which the platen 34 is arranged. As the drive roller 30 rotates in the direction of arrow A, the drive roller 30 causes the idler roller 36 to rotate in the direction of arrow B.

Both the print head arm 26 and the drive roller 30 are resiliently mounted so as to be biased in a direction towards the cassette 20. In particular, the print head arm 26 is arranged to urge the print head 22 against the platen 34 when the cassette 20 is inserted in the cassette receiving bay 18. Likewise, the drive roller 30 is biased so as to be urged against the idler roller 36 so that the image receiving tape 24 can be driven by the rotation of the drive roller 30 through the tape printing apparatus 2.

The cassette 20 is inserted in the cassette receiving bay 18 in the direction of arrow C. The platen 34 on the side wall 37 of the cassette 20 comes into contact with the biased print head 22, with the image receiving tape 24 being between the platen 34 and the print head 22. Good contact between the print head 22 and the platen 34 is ensured by the biasing of the print head 22 in the direction towards the platen 34. The idler roller 36 also comes into contact with the drive roller 30, again with the image receiving tape 24 therebetween. As a result of the biasing of the drive roller 30, the drive roller 30 is urged against the idler roller 36 so that the image receiving tape 24 can be driven through the tape printing apparatus 2 as a result of the rotation of the idler roller 36 and the drive roller 30.

The cassette 20 is retained in place by clips 38. The clips 38 are provided in the cassette receiving bay 18 and clip over the cassette 20 to retain it in place. These clips 38 may be manually operated by the user. In one preferred embodiment, the clips 38 automatically engage the cassette 20, when the cassette 20 is inserted into the cassette receiving bay 18. To remove the cassette 20, the user manually moves the clips 38 out of place. It should be appreciated that any suitable clip or catch member can be used to retain the cassette 20 in place. The clips 38 are arranged to engage the two corners 41 and 43 of the cassette 20 which are further from the print head 26 and the drive roller 30. The cassette 20 could alternatively be released from the clips 38 by activating a button or lever provided externally of the cassette receiving bay 18.

In a modification to this embodiment, the cassette bay lid 40, which may be hinged or sliding, is arranged to push the cassette 20 into the operative position as the lid 40 is closed. Members which protrude from the lid 40 into the cassette receiving bay 18 may be used to push the cassette into position. The lid 40 may then itself latch to retain the lid closed and the cassette 20 in position.

Reference will now be made to FIG. 18 which shows a modification to the embodiment shown in FIG. 17. Like parts are indicated by like reference numerals and accordingly only those parts which are different will be described. The cassette 120 is provided with a planar drive surface 136 on the same wall 137 of the cassette 120 on which the platen 34 is defined. This drive surface 136 is of a low friction material and replaces the idler roller 36 of the first embodiment. The drive surface 136 cooperates with the drive roller 30 which is biased towards the drive surface 136 to drive the image receiving tape 24 through the tape printing apparatus.

The cassette 120 is provided with a slot 122. When the cassette is in the cassette receiving bay 18, a cutter blade 124 is arranged to move into the slot 122 during a cutting operation to thereby separate the image receiving tape 24 on which an image has been printed from the supply 32 of image receiving tape. The cut portion of image receiving tape 24 defines a label and exits the cassette receiving bay 118 through slot 126.

The cassette receiving bay 118 is additionally provided with a pair of arms 138 for retaining the cassette 120 in position. The arms 138 are made of a resilient material and are biased to adopt the position shown in FIG. 18. The free end 139 of each arm has an angled surface 140. As the cassette 120 is inserted into the cassette receiving bay 118 in the direction of arrow D, the corners 121 of the cassette 120 adjacent the wall 137 supporting the platen 34 and the drive surface 123 engage the angled surfaces 140 and urge the arms 138 away from each other. The arms 138 are held by the sides 144 of the cassette 120 in this position until the cassette 120 is fully inserted, and the other two corners 141 of the cassette 120 have passed the angled surfaces 140. The arms 138 move in a direction towards one another so as to be once more in the position shown in FIG. 18. As mentioned hereinbefore the arms 138 are biased to the position shown in FIG. 18. The other two corners 141 of the cassette 120 are accommodated in corners 142 defined at the end of each arm 138 between the free end 139 and a main portion 143 of each arm 138. The cassette 120 is thereby retained in position by the arms 138 with the print head 22 biased against the platen 34 and the drive roller 30 biased against the drive surface 136.

When the cassette 120 is fully received in the cassette receiving bay 118, the side walls 144 of the cassette 120, perpendicular to the wall 137 on which the platen 34 and the drive surface 121 are supported, are in contact with protrusions 146 defined on the main portions 143 of the arms 138. The combination of the protrusions 146 together with the corners 142 of the arms 138 retains the cassette 120 in the cassette receiving bay 118 and prevents significant movement of the cassette 120.

When the cassette 120 is to be removed from the cassette receiving bay 118, the arms 138 are pushed together by applying an inward pressure at area 135 and in the direction indicated by arrows E. This causes the arms 138 to move about a pivot region defined by the protrusions 146. The free ends 139 of the arms 138 therefore move in a direction away from each other and the cassette 120 can be removed from the cassette receiving bay 118 as the arms 138 no longer retain the cassette 120 in position.

By using a flat platen, as in the fifth and sixth embodiments, which cooperates with the print head rather than a curved roller, as in the prior art, the costs of manufacturing the tape printing apparatus can be reduced. This is because the curved nature of the prior art roller surface imposes tight restrictions on the allowable position of the print line relative to the roller platen. In other words, there is an optimum line on the platen at which contact should be made with the print head. In contrast, with a flat platen, the area of the platen on which contact can be made with the print head to achieve good quality printing is much larger. This leads to lower production costs as the relative position of the print head and platen is not as critical as in the prior art.

The above embodiments may be modified so that the cassette receiving bay lid 40 is replaced by a much smaller opening through which the cassette is inserted in the direction of arrow C or arrow D. In particular the cassette is inserted in a direction parallel to the planar surfaces defining the upper and lower surfaces of the cassette. The provision of a relatively large lid cover over the cassette receiving bay may has the disadvantages that the appearance of the product may be compromised and that the large lid is a weak point if the tape printing apparatus is dropped. The use of the relatively small opening may overcome these disadvantages. In particular, the cassette receiving bay may have an opening corresponding to the maximum cross-sectional dimension of the cassette. In contrast, the prior art arrangements require a cassette bay opening at least as large as the maximum planar dimension of the cassette.

The above described embodiments may have the advantage that tape jamming resulting from the tape catching on the printing mechanism can be reduced. In particular, in the known arrangements, the tape has to be dropped down between a platen and a print head which are both provided by the tape printing apparatus. During insertion the tape may snag on the edge of the print head or the platen which may lead to subsequent jamming. In the first and second embodiments, the platen is provided on the cassette. Accordingly, the cassette can be inserted in the direction of arrow C or arrow D and the tape is not dropped down into position as in the known arrangements. The tape is thus less likely to snag leading to fewer tape jams.

What is claimed is:

1. A tape printing apparatus (2) having a platen (434) for driving an image receiving tape (24) through a printing zone, and a motor (42) operatively connected to said platen by means of a gear train (480), wherein said motor (42) and said gear train (480) are approximately located within a plane in which a supply (32) of said image receiving tape (24) accomodated in said tape printing apparatus (2) is arranged, and wherein a pair of gears of said gear train (480) changes the direction of the rotation of the torque driving the platen (434) by 90°, such that the rotational axis of said platen (434) and a driving shaft of said motor (42) include an angle of 90°.

2. A tape printing apparatus (2) according to claim 1 wherein the motor (42) and the gear train (480) are located besides a zone in which said supply (32) of image receiving tape (24) is accomodated in said tape printing apparatus (2).

3. A tape printing apparatus (2) according to claim 1, wherein the driving shaft of said motor (42) extends parallel to the plane in which the supply (32) of said image receiving tape (24) accomodated in said tape printing apparatus (2) is arranged.

4. A tape printing apparatus according to one of claim 1, wherein the rotational axis of said platen (434) extends parallel to the plane in which the supply (32) of said image receiving tape (24) accomodated in said tape printing apparatus (2) is arranged.

5. A tape printing apparatus according to one of claim 1, wherein the motor (42) is located within the plane defined by the cassette (443) housing the supply (32) of image receiving tape.

6. A tape holding case (20, 220, 243, 260, 443) for use with a tape printing apparatus (2) having a print head (22, 222, 322, 422) for printing an image on an image receiving tape (24) and a surface (34, 234, 334, 434), said print head and said surface having a first printing position in which said print head acts against said surface and a second non-printing position in which said print head and said surface are spaced apart, said tape holding case housing a supply (32) of image receiving tape (24) and having an interaction portion (246, 446) for separating the print head and the surface so that the print head and the surface are in the second position during insertion of the tape holding case in the tape printing apparatus, said interaction portion being arranged so that the print head and the surface are in the first position when the tape holding case is received in said tape printing apparatus.

7. A tape holding case (20, 220, 243, 260, 443) as claimed in claim 6, wherein the print head and said surface are normally in the first position and the interaction portion is arranged during insertion to cause the print head and the surface to adopt the second position, said print head and said surface being in the first position when the tape holding case is received in said tape printing apparatus.

8. A tape holding case (20, 220, 243, 260, 443) as claimed in claim 6, wherein said interaction portion comprises a nose portion (246) or a control surface (446) extending generally in the direction of insertion.

9. A tape holding case (243, 443) as claimed in claim 8, wherein said nose portion (246) or control surface (446) has a first surface (248) shaped so as to gradually move the print head and/or the surface to cause the print head and the surface to adopt the second position as the tape holding case is inserted and a second surface (250) shaped so as to gradually move back the print head and/or the surface to cause the print head and the surface to adopt the first position so that when the tape holding case is fully inserted in said tape printing apparatus, said print head and said surface are in the first position.

10. A tape holding case as claimed in claim 9, wherein said first and second surfaces are angled in opposite directions.

11. A tape holding case as claimed in claim 6, wherein a window (244, 266, 466) is provided in said tape holding case (220, 243, 260,443) adjacent said interaction portion, said image receiving tape (24) being arranged to extend across said window, whereby when the tape holding case (220, 243, 260, 443) is received in said tape printing apparatus (2), the print head and said surface are in the first position with the print head on one side of the window and the surface on the other side of the window.

12. A tape holding case (220, 243, 260, 443) as claimed in claim 6, wherein said print head is mounted on a support member (226, 328, 468) and said interacting portion is arranged to contact said support member during insertion of said tape holding case (220, 243, 260, 443).

13. A tape holding case as claimed in claim 12, wherein said interacting portion is arranged to contact said print head support member at a location separate from the print head and/or at the print head.

14. A tape holding case claimed in claim 6 wherein said interaction portion has guide means for guiding said image receiving tape (24).

15. A tape holding case (220, 243, 260, 443) as claimed in claim 14, wherein said guide means comprises a substantially enclosed channel (246, 465).

16. A tape holding case (220, 243, 260, 443) as claimed in claim 15, wherein said channel (246, 465) has a box-like cross-section.

17. A tape holding case (260) as claimed in claim 6, wherein reinforcing means (268) are provided between a main body of the tape holding case (260) and the interaction portion.

18. A tape holding case (260) as claimed in claim 17, wherein said reinforcing means, said main body and said interaction portion define a recess for accommodating said print head or said surface of the tape printing apparatus.

19. A tape printing apparatus for printing an image on image receiving tape (24), comprising:

means for receiving a supply (32) of image receiving tape (24);

a print head for printing an image on said image receiving tape (24), said print head having a first position in which the print head acts against a surface to print an image on the image receiving tape, a second non-printing position and a third position intermediate said first and second positions; and moving means arranged automatically to move said print head from said third position to said first position when said print head is at the third position.

20. A tape printing apparatus as claimed in claim 19, wherein said moving means comprises biasing means.

21. A tape printing apparatus as claimed in claim 20, wherein said biasing means comprises a spring (336).

22. A tape printing apparatus as claimed in claim 19, wherein said print head is mounted on a member (328), said member (328) having a first portion (342) which co-operates with a supply (32) of image receiving tape (24) as said supply (32) is inserted in said receiving means, wherein insertion of the supply of image receiving tape (24) causes the print head to move from said second position to said third position.

23. A tape printing apparatus as claimed in claim 22 wherein said member (328) has a second portion (327) arranged below said receiving means, said first portion (342) being supported by second portion and being in said receiving means.

24. A tape printing apparatus as claimed in claim 22, wherein said first portion (342) has a sloping surface (343) arranged to contact said supply of image receiving tape (24).

25. A tape printing apparatus as claimed in claim 22 wherein as said print head (322) is moved from said first position to said second position, the first portion is arranged to push the supply of image receiving tape (24) out of said receiving means.

26. A tape printing apparatus as claimed in claim 19, wherein said member (328) is substantially L-shaped, said print head (322) mounted on one arm of said L-shape, the first portion (342) of said member (328) being on the other arm of said L-shape and said moving means being coupled to said member.

27. A tape printing apparatus as claimed in claim 19 wherein said print head has a fourth position intermediate said first and second positions, said moving means being arranged automatically to move said print head from said fourth position to said second position when said print head is at said fourth position.

28. A tape printing apparatus as claimed in claim 19 wherein said moving means comprises an over-center mechanism.

29. A tape printing apparatus as claimed in of claim 19 in combination with a supply (32) of image receiving tape (24) received in a cassette (260).

30. A tape printing apparatus as claimed in claim 19 further including:

a tape holding case (443) housing a supply (32) of image receiving tape (24) comprising:

a tape spool configured to supply the tape;

a cutting location in which the tape is to be cut; and means to bend the tape approximately 9020 only once as the tape moves from the spool to the cutting location.

31. A tape printing apparatus for printing an image on an image receiving tape comprising:

means for receiving a supply (32) of image receiving tape (24);

a print head for printing an image on said image receiving tape;

a surface against which said print head co-operates to print an image on said image receiving tape, said surface having a first position in which said surface acts against the print head and a second position in which the said surface is spaced apart from said print head, said surface further having a third position intermediate said first and second positions; and moving means arranged automatically move said surface from said third to said first position when said surface is at the third position.

32. A tape printing apparatus as claimed in claim 31 further including:

a tape holding case (443) housing a supply (32) of image receiving tape (24) comprising:

a tape spool configured to supply the tape;

a cutting location in which the tape is to be cut; and means to bend the tape approximately 90° only once as the tape moves from the spool to the cutting location.

* * * * *

UNITED STATES PATENT AND TRADEMARK OFFICE

CERTIFICATE OF CORRECTION

PATENT NO. : 6,152,623
DATED : November 28, 2000
INVENTOR(S) : Palmer, et al.

It is certified that error appears in the above-identified patent and that said Letters Patent is hereby corrected as shown below:

Column 20, line 26 (claim 30, line 7): change "9020" to --90°--.

Signed and Sealed this

Eighth Day of May, 2001

*Attest:*

Nicholas P. Godici

NICHOLAS P. GODICI

*Attesting Officer*

*Acting Director of the United States Patent and Trademark Office*